US011634910B2

(12) United States Patent
Leslie

(10) Patent No.: US 11,634,910 B2
(45) **Date of Patent: *Apr. 25, 2023**

(54) SUMP DRAIN APPARATUS, SYSTEM, AND METHOD OF CONSTRUCTION

(71) Applicant: JMH Innovative Solutions, LLC, Roanoke, TX (US)

(72) Inventor: David Leslie, Roanoke, TX (US)

(73) Assignee: JMH INNOVATIVE SOLUTIONS, LLC, Roanoke, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/337,118

(22) Filed: Jun. 2, 2021

(65) Prior Publication Data

US 2021/0396015 A1 Dec. 23, 2021

Related U.S. Application Data

(63) Continuation of application No. 16/882,148, filed on May 22, 2020, now Pat. No. 11,060,292, which is a continuation-in-part of application No. PCT/US2019/064298, filed on Dec. 3, 2019, which is a continuation-in-part of application No. 16/214,432, filed on Dec. 10, 2018, now Pat. No. 10,760,275.

(51) Int. Cl.
*E04D 13/04* (2006.01)
*E04D 13/16* (2006.01)

(52) U.S. Cl.
CPC ..... *E04D 13/0481* (2013.01); *E04D 13/0409* (2013.01); *E04D 13/1606* (2013.01); *E04D 2013/0413* (2013.01)

(58) Field of Classification Search
CPC ..... E04D 13/0409; E04D 13/0445; E04D 13/0481; E04D 13/16; E04D 13/1606; E04D 2013/0409; E04D 2013/0413; E04D 2013/0436; E04D 2013/0445; E04D 2013/0481
USPC ..... 210/163; 52/302.1, 302.6
See application file for complete search history.

(56) References Cited

U.S. PATENT DOCUMENTS

| | | | |
|---|---|---|---|
| 1,963,300 | A | 6/1934 | Fleming |
| 2,091,927 | A | 8/1937 | Hirshstein |
| 2,284,416 | A | 5/1942 | Gordon |
| 3,095,219 | A | 6/1963 | La Verne |
| 4,487,690 | A | 12/1984 | Logsdon |
| 4,505,814 | A | 3/1985 | Marshall |

(Continued)

FOREIGN PATENT DOCUMENTS

| | | |
|---|---|---|
| DE | 6942758 | 1/1970 |
| DE | 19840593 | 3/2000 |

OTHER PUBLICATIONS

International Searching Authority, International Search Report and Written Opinion dated Aug. 19, 2021 in Application No. PCT/US2021/033243.

(Continued)

*Primary Examiner* — Christopher Upton
(74) *Attorney, Agent, or Firm* — Snell & Wilmer L.L.P.

(57) ABSTRACT

The present disclosure provides a sump drain apparatus comprising a drain inlet and a ramp coupled to the drain inlet comprising an incline plane configured to divert drainage water toward the drain bowl, wherein at least a portion of the ramp is configured to be positioned on top of a roof deck.

20 Claims, 26 Drawing Sheets

(56) References Cited

U.S. PATENT DOCUMENTS

| | | | | |
|---|---|---|---|---|
| 4,864,781 | A * | 9/1989 | Emblin | E04D 13/1606 52/404.3 |
| 5,378,356 | A | 1/1995 | Logsdon | |
| 7,946,087 | B1 | 5/2011 | Seitzinger | |
| 9,518,389 | B1 | 12/2016 | McDanal | |
| 10,760,275 | B2 | 9/2020 | Leslie | |
| 11,060,292 | B2 * | 7/2021 | Leslie | E04D 13/0409 |
| 2003/0037498 | A1 | 2/2003 | Bishop | |

OTHER PUBLICATIONS

ISA; International Search Report and Written Opinion dated Feb. 20, 2020 in Application No. PCT/US/2019/064298.

Firestone Building Products Specification Sheet, Roof Drain, BU-D-1, http://firestonebpco.com/assets/2013/03/dd_bur_d_01_01-01-2006-pdf.pdf, (revision date Jan. 17, 2014).

Firestone Building Products Specification Sheet, Roof Drain with Steep Slope Sump, D-4, http://firestonebpco.com/assets/2013/03/dd_rubbergard-epdm_d_04_01-01-2006-pdf.pdf, (revision date Jul. 8, 2014).

Firestone Building Products Specification Sheet, Roof Drain, TPO-SA-D-1, http://firestonebplac.com/assets/2013/03/dd_tpo-sa_d_01_08-09-20111-pdf.pdf, (revision date Aug. 9, 2011).

OMG Roofing Products Specification Sheet, Hercules TPO-Coated RetroDrain Assembly, https://www.omgroofing.com/files/roofing-2014/documents/general/files/TPO%20PVC%20RetroDrain%20Thermoplastic.pdf, revisision date Aug. 8, 2011).

USPTO, Non-Final Office Action dated Feb. 19, 2020 in U.S. Appl. No. 16/214,432.

USPTO, Notice of Allowance dated Apr. 22, 2020 in U.S. Appl. No. 16/214,432.

USPTO, Non-Final Office Action dated Nov. 12, 2020 in U.S. Appl. No. 16/882,148.

USPTO, Notice of Allowance dated Mar. 24, 2021 in U.S. Appl. No. 16/882,148.

* cited by examiner

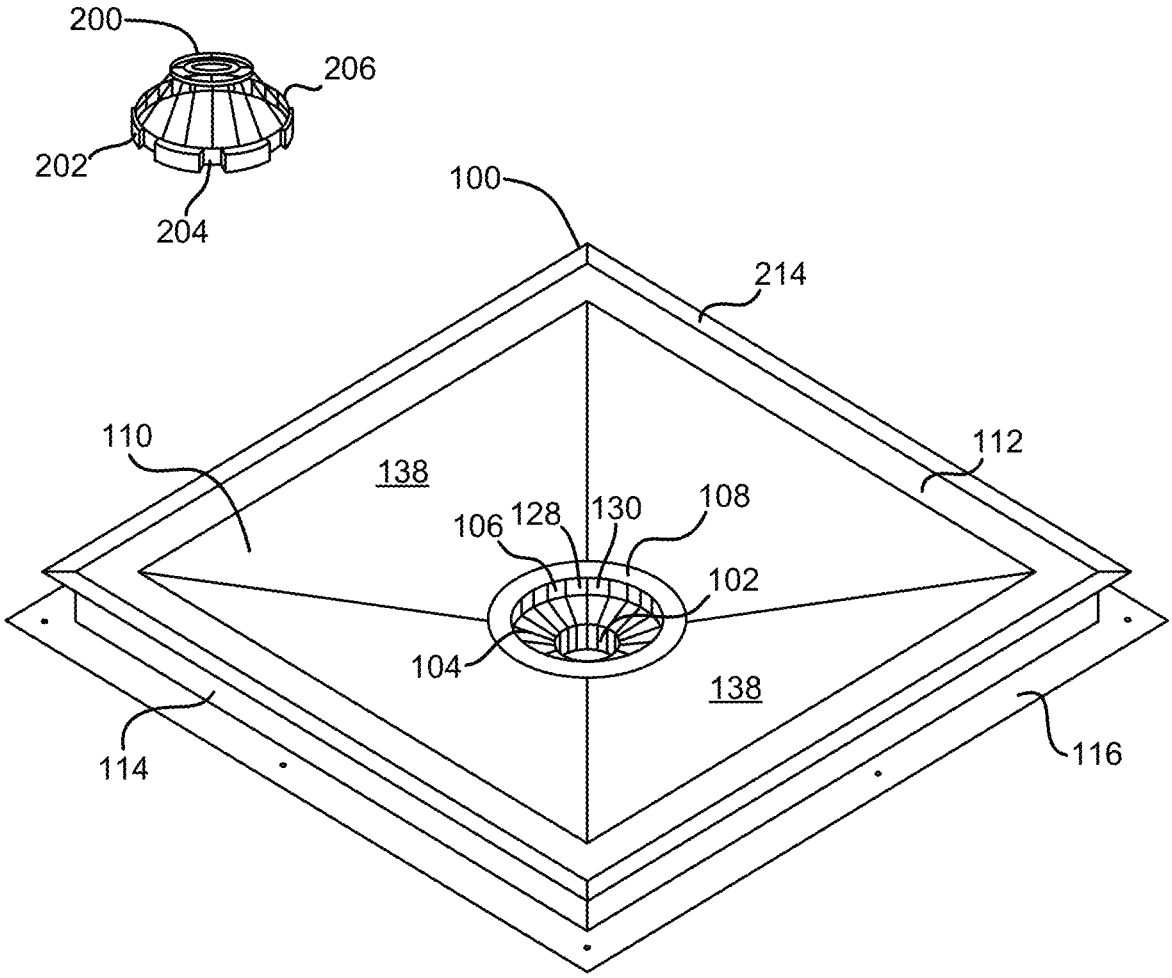
FIG. 1
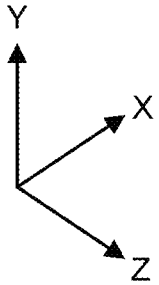

SUMP DRAIN APPARATUS, SYSTEM, AND METHOD OF CONSTRUCTION

CROSS-REFERENCE TO RELATED APPLICATIONS

This application is a Continuation of, and claims priority to and the benefit of, U.S. patent application Ser. No. 16/882,148, filed May 22, 2020 and entitled "SUMP DRAIN APPARATUS, SYSTEM, AND METHOD OF CONSTRUCTION," which is a Continuation-In-Part of, and claims priority to and the benefit of, International Application No. PCT/US19/64298, filed Dec. 3, 2019 and entitled, "SUMP DRAIN APPARATUS, SYSTEM, AND METHOD OF CONSTRUCTION," which claims priority to and the benefit of U.S. patent application Ser. No. 16/214,432, now U.S. Pat. No. 10,760,275, filed Dec. 10, 2018 and entitled "SUMP DRAIN APPARATUS, SYSTEM, AND METHOD OF CONSTRUCTION," all of which are hereby incorporated by reference herein.

FIELD OF THE DISCLOSURE

The present disclosure relates to a water evacuation apparatus, system, and method of construction, and more specifically, to an insulated roof sump drain apparatus, system, and method of construction.

BACKGROUND OF THE DISCLOSURE

Conventional roofing systems typically include drainage systems configured to remove water on the roof resulting from precipitation. There are two basic types of drainage systems: perimeter evacuation systems in which water is transported to an edge of a roof prior to removal and internal evacuation systems in which water is transported to an isolated area on the roof prior to removal. Internal evacuation systems in particular may be prone to leaking due to the proximity of mating points between components near areas of high concentration of water.

SUMMARY OF THE DISCLOSURE

A sump drain apparatus may comprise a drain inlet (e.g., comprising an inlet conduit and/or a drain bowl) and a ramp connected to the drain bowl comprising an incline plane configured to divert drainage water toward the drain bowl. A sump drain may comprise an attachment portion (e.g., a fastener aperture, attachment flange, and/or the like), which may be configured to couple the sump drain apparatus to a roof deck. The ramp may be configured to be positioned on top of the roof deck. Sump insulation may be disposed beneath the ramp and above the roof deck. The attachment portion (e.g., an attachment flange) may be coupled to the ramp. In various embodiments, the attachment portion may be coupled to the ramp by an insulation receiving surface coupled to and extending downward from the ramp, between the ramp and attachment portion.

In various embodiments, the drain inlet, the ramp, insulation receiving surface, and/or the attachment portion may comprise a single, continuous structure. The drain inlet may be connected to the ramp directly, or with a first land spanning between the drain inlet and the ramp. In various embodiments, the attachment portion may be connected to the ramp directly, or with a second land and/or an insulation receiving surface spanning between the attachment portion and the ramp. In various embodiments, the attachment portion may be disposed in or through the ramp and/or the second land. The drain inlet may be connected to and/or continuous with an outlet conduit. The inlet conduit of the drain inlet may comprise an annular shape and may be configured to couple to a drain bowl strainer. The insulation receiving surface may be substantially perpendicular to the second land and/or attachment portion and positioned between the second land and attachment portion. The first land may comprise an upper surface and a lower surface, the lower surface configured to rest on the roof deck. The insulation receiving surface may be configured to couple to an insulation retention clip and abut roof insulation.

A sump drain system for a roof may comprise a sump drain apparatus comprising a drain inlet and/or a ramp connected to the drain inlet comprising an incline plane configured to divert drainage water toward the drain bowl. In various embodiments, a sump drain apparatus may comprise an attachment portion configured to couple the sump drain apparatus to a roof deck. The ramp may be configured to be positioned on top of the roof deck and contain sump insulation beneath the ramp and above the roof deck.

In various embodiments, the drain inlet and the ramp may comprise a single, continuous structure. The attachment portion may also be a single, continuous structure with the drain bowl and ramp. In various embodiments, the sump drain system may further comprise an insulation retention clip coupled to an insulation receiving surface of the sump drain apparatus. The sump drain system may further comprise a drain bowl strainer coupled to an inlet conduit of the sump drain apparatus. The sump drain apparatus may further comprise an outlet conduit connected to and/or continuous with the drain inlet. The sump drain system may further comprise a drain pipe coupled to the outlet conduit. The sump drain apparatus may further comprise a first land and a second land connected to and/or continuous with the ramp. The sump drain system may further comprise a roof membrane coupled to the second land, wherein the roof membrane is one of thermally coupled to, chemically coupled to, coupled to by way of adhesive, cured to, or welded to the second land.

A method of constructing roof sump drain system may comprise forming a hole in a roof deck, coupling a sump drain apparatus to the roof deck, coupling roof insulation to the roof deck and sump drain apparatus, and coupling a roof membrane to the sump drain apparatus over the roof insulation.

In various embodiments, the sump drain apparatus may comprise a drain inlet and a ramp connected to the drain inlet comprising an incline plane configured to divert drainage water toward the drain bowl. In various embodiments, the sump drain apparatus may comprise an attachment portion configured to couple the sump drain apparatus to a roof deck. The ramp may be configured to be positioned at least partially on top of the roof deck and contain sump insulation beneath the ramp and above the roof deck. The method may further comprise inserting the roof insulation beneath an insulation retention clip coupled to the sump drain apparatus.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure. Elements with the like element numbering throughout the figures are intended to be the same.

FIG. 1 illustrates a perspective view of a sump drain frame and a drain bowl strainer, in accordance with various embodiments;

DETAILED DESCRIPTION

Figure 2:
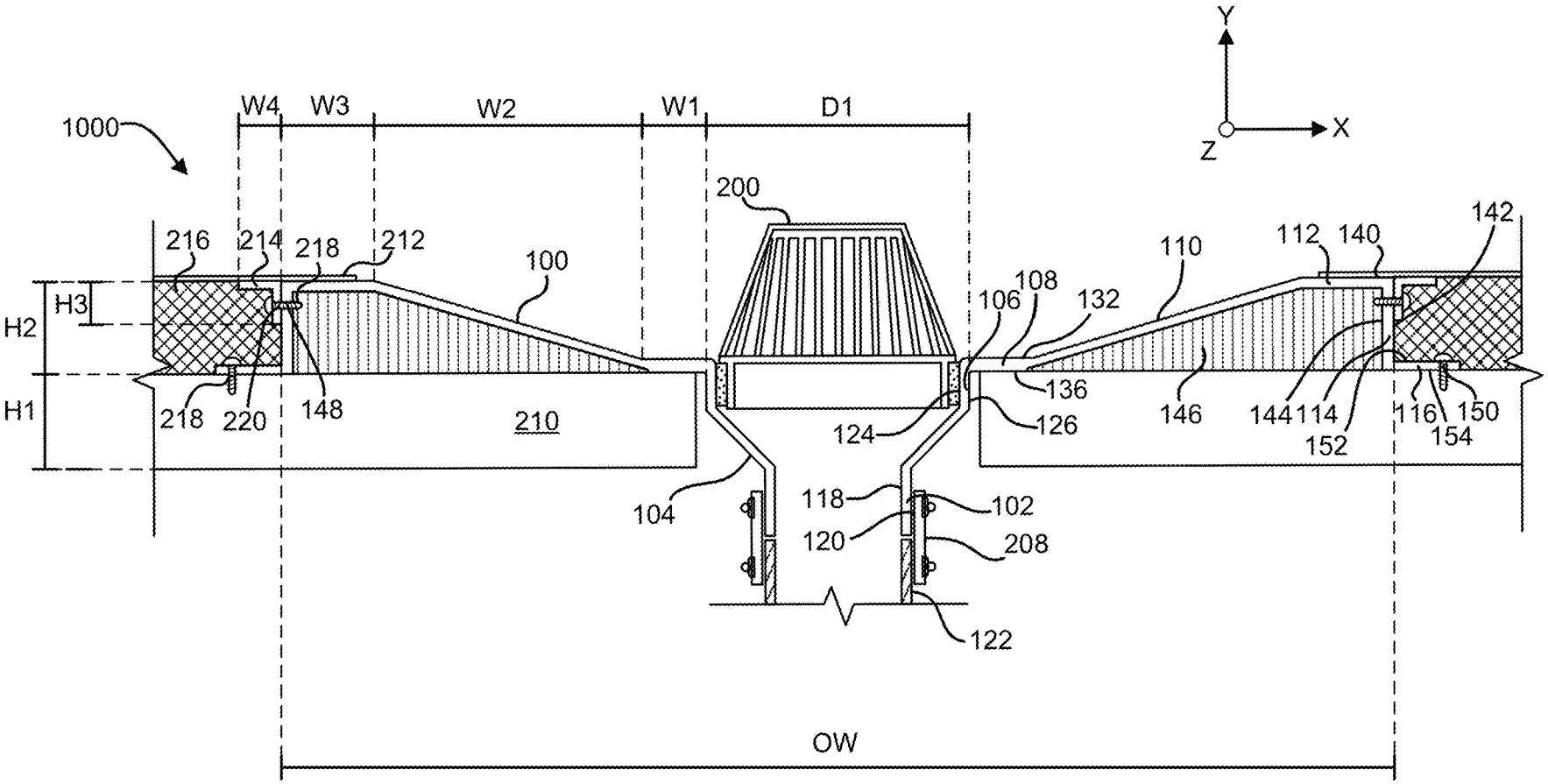
FIG. 2 illustrates a cross-sectional side view of a sump drain frame coupled to a sump drain system, in accordance with various embodiments.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with roofing drainage systems. However, various aspects of the disclosed embodiments may be adapted for performance in a variety of other drainage systems. As such, numerous applications of the present disclosure may be realized.

Various problems exist with known roofing drainage systems. For example, many contemporary drainage systems comprise many components of different materials coupled together to form the completed drainage system. Naturally, these components have different coefficients of thermal expansion, thereby expanding and contracting at different rates. Such differences in the expansion and contraction of components can lead to deterioration of the seal of the drainage system, thereby resulting in the intrusion of water past the drainage system into the underlying building.

Traditional drainage systems utilize three main components: a drain bowl, an insulated sump area, and a roof membrane. Typically, a hole is first cut into the deck of the roof which will receive the drain bowl. The drain bowl is then mechanically attached to the roof deck. An insulated sump area in the form of wedged insulation is installed directly onto the roof deck around the hole and configured to allow water to flow on a downward gradient towards the drain. The insulated sump is then covered by a waterproof membrane over the sump insulation and draped down into the hole onto the drain bowl. A compression ring is then inserted over the top of the membrane and fastened to the drain bowl or other components immediately adjacent to the hole using mechanical fasteners. Such an arrangement is intended to provide a waterproof route for drainage water from various portions of the roof to the drain.

Arrangements such as those described above may concentrate drainage water near the mating point of multiple components, thereby increasing a likelihood that water will move beyond its intended route and leak into the underlying building. Further, by placing the membrane near the drain, the membrane may tend to bow under the pressure of the compression ring, thereby potentially inhibiting water movement toward the drain and resulting in large areas of standing water around the drain. Overtime, this may result in structural failure of the roof or a potential collapse of the roof due to the weight of the standing water. Additionally, such systems may be costly to manufacture, require long installation times, and may be at a higher risk of being installed incorrectly.

Accordingly, with reference to FIG. 1, a perspective view of a sump drain frame 100 and drain bowl strainer 200 detached from sump drain frame 100 is illustrated, in accordance with various embodiments. Sump drain frame 100 may comprise a single-piece component configured to direct drainage water from surrounding areas of a roof to a drain placed at and/or near a center of sump drain frame 100. In various embodiments, sump drain frame 100 may comprise any suitable material, for example a polymer, metal, ceramic, or composite material in accordance with various embodiments. More specifically, sump drain frame 100 may comprise a thermoplastic material such as a thermoplastic olefin (TPO), which may include polypropylene (PP), polyethylene (PE), or block copolymer polypropylene. In various embodiments, sump drain frame 100 may comprise a polyvinyl chloride material (PVC). Sump drain frame 100 material may comprise one or more fillers such as talc, fiberglass, carbon fiber, wollatonite, or metal oxy sulfate. Sump drain frame 100 may comprise an elastomer such as ethylene propylene diene terpolymer (EPDM), ethylene-octene, ethylbenzene, or styrene ethylene butadiene styrene. Any suitable manufacturing technique may be utilized to form sump drain frame 100. For example, in accordance with various embodiments, sump drain frame 100 may be cast, forged, additively manufactured, molded through an injection molding or vacuum forming process, or any other suitable technique.

Figure 3:
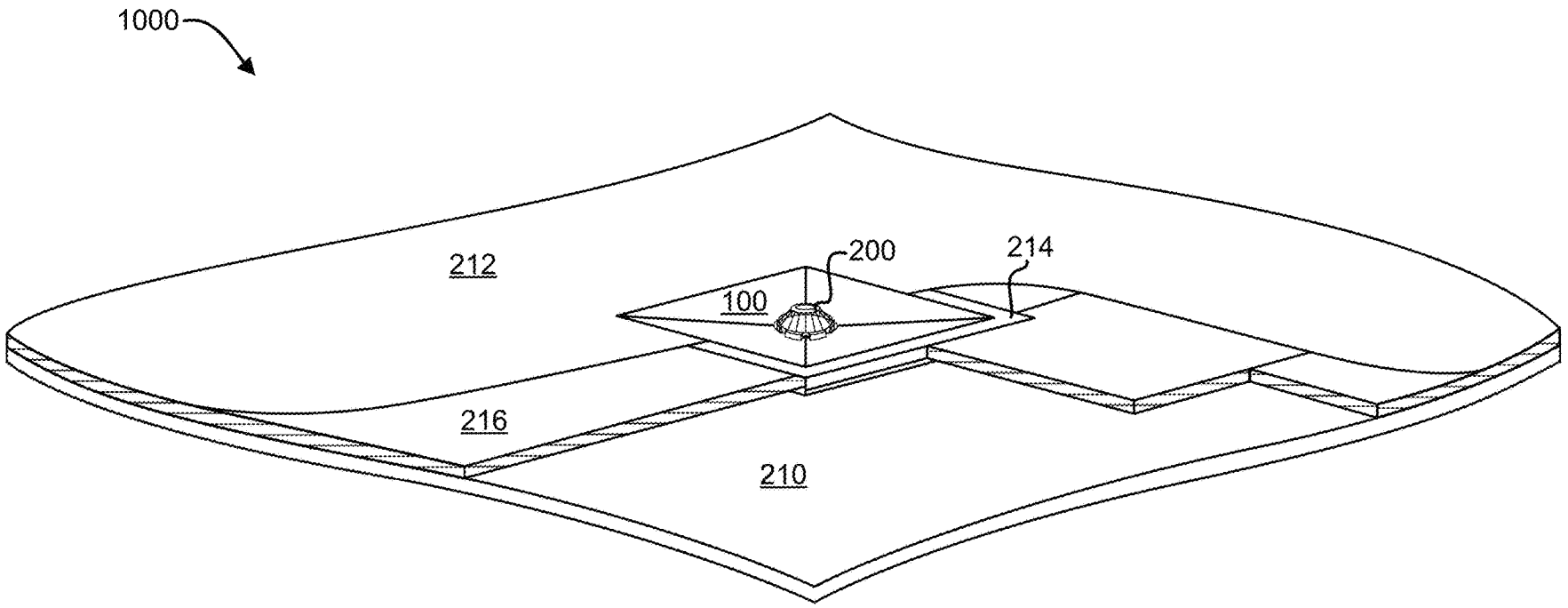
FIG. 3 illustrates a perspective view of a partially constructed sump drain system, in accordance with various embodiments.

Referring now to FIG. 1-FIG. 3, sump drain frame 100 may form a portion of a sump drain system 1000, in accordance with various embodiments. Sump drain frame 100 may comprise an outlet conduit 102, a drain inlet (e.g., comprising a drain bowl 104 and/or an inlet conduit 106), a first land 108, a ramp 110, a second land 112, an insulation receiving surface 114, and/or an attachment portion. Any combination, or all, of these components may make up a single, unitary, and/or monolithic component (the sump drain frame), which does not have any seams or cracks between the components.

Outlet conduit 102 may comprise any suitable shape, such as an annular inner surface 118 and an annular outer surface 120. Annular inner surface 118 may be configured to contain drainage water and transfer drainage water downward (in the negative Y-direction) to a drain pipe 122 situated below outlet conduit 102. The outlet conduit may be coupled to a drain pipe. For example, annular outer surface 120 may be configured to couple sump drain frame 100 to drain pipe 122 using a coupling such as a no-hub connector or other suitable device 208. For example, in various embodiments, sump drain frame 100 may be aligned with drain pipe 122 such that outlet conduit 102 substantially aligns with drain pipe 122. A no-hub connector may be inserted over a mating point between outlet conduit 102 and drain pipe 122 and tightened to secure sump drain frame 100 to drain pipe 122. In such a way, drainage water being evacuated from a roof surface may be transferred from sump drain frame 100 to drain pipe 122 through outlet conduit 102.

Figure 7A:
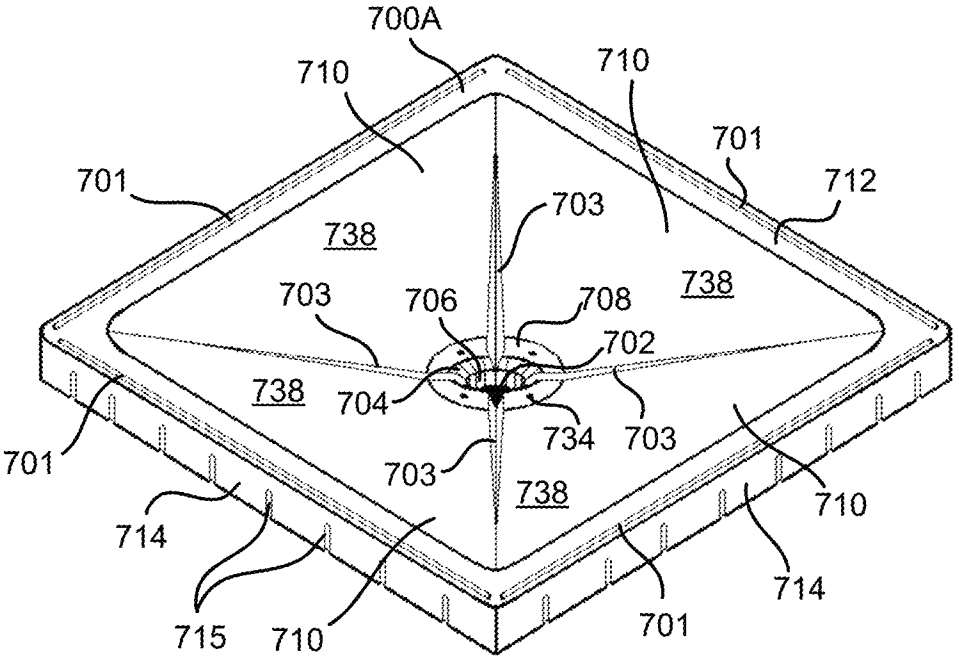
FIG. 7A illustrates a perspective view of a sump drain frame, in accordance with various embodiments.
Figure 7B:
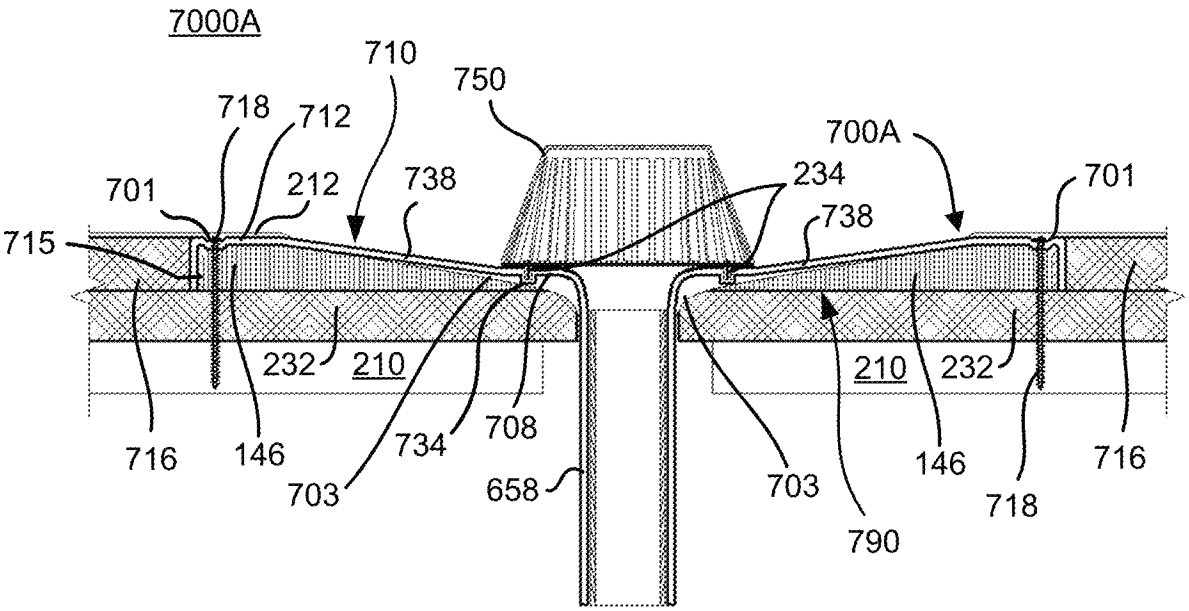
FIG. 7B illustrates a cross-sectional side view of the sump drain frame of FIG. 7A and a drain bowl strainer of a sump drain system, in accordance with various embodiments.
Figure 7C:
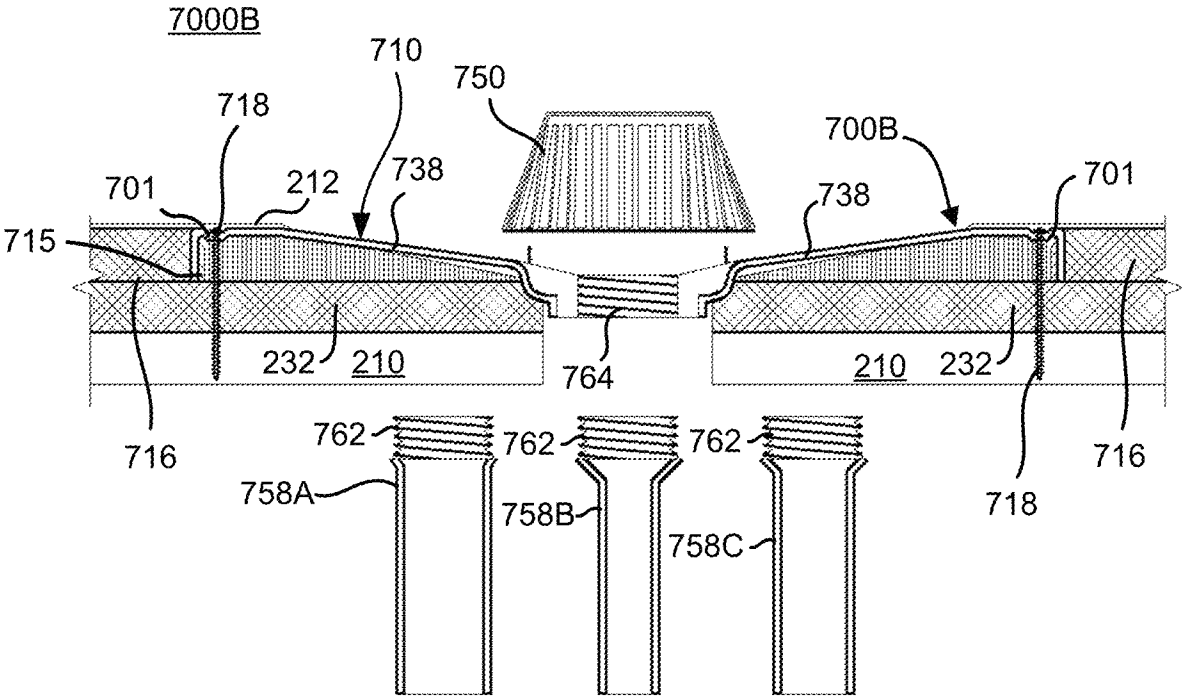
FIG. 7C illustrates a cross-sectional side view of a sump drain frame and a drain bowl strainer of a sump drain system, in accordance with various embodiments.

In various embodiments, with additional reference to FIG. 7C, an outlet conduit (e.g., outlet conduit 758A-758C) may be a separate piece from and coupled to a sump drain frame (e.g., sump drain frame 700B). An outlet conduit may comprise an interface to couple with a complementary interface of the sump drain frame. For example, an outlet conduit may comprise threading (e.g., threading 762) or other specific geometry or configuration to couple with the sump drain frame. The sump drain frame may comprise a complementary threading and/or geometry or configuration (e.g., complementary threading 764) to receive and couple with the outlet conduit. In various embodiments, an outlet conduit may comprise an outer wall configured to converge, and form at least a partial seal, with the sump drain frame (e.g., a drain bowl, inlet conduit, first land, or ramp, of the sump drain frame). In various embodiments, an outlet conduit may comprise a transitional surface, which may be angled from a surface configured to converge, and form at least a partial seal, with the sump drain frame (e.g., a drain bowl, inlet conduit, first land, or ramp, of the sump drain frame). The transitional surface (such as those depicted in outlet conduits 758A-758C) may be configured to converge a flow of drainage water into the outlet conduit and/or drain pipe. Accordingly, such a transitional surface may be a drain bowl.

Referring back to FIGS. 1-3, in various embodiments, a drain inlet may comprise a drain bowl 104 and/or an inlet conduit 106. In various embodiments, drain bowl 104 may be positioned above (in the positive Y-direction) and connected to outlet conduit 102. Drain bowl 104 may comprise any suitable shape, such as a frusto-conical or frusto-pyramidal shape. In various embodiments, drain bowl 104 may be directly coupled to a first land (e.g., first land 108) and/or a ramp (e.g., ramp 110). In various embodiments, drain bowl 104 may be coupled to an inlet conduit 106, which is coupled to and/or spanning between drain bowl 104 and first land 108 and/or ramp 110. Drain bowl 104 may be configured to converge a flow of drainage water from ramp 110, first land 108, and/or inlet conduit 106 (in the negative Y-direction) into an outlet conduit and/or drain pipe.

Inlet conduit 106 may comprise any suitable shape, such as an annular shape comprising an annular inner surface 124 and an annular outer surface 126. A diameter, D1, of annular outer surface 126 of inlet conduit 106 may be between approximately 8 inches (20.32 cm) and 16 inches (40.64 cm), be between approximately 10 inches (25.40 cm) and 14 inches (35.56 cm), or approximately 12 inches (30.48 cm), in various embodiments. Annular inner surface 124 may be configured to receive and couple to drain bowl strainer 200.

For example, in various embodiments, inlet conduit 106 and drain bowl strainer 200 may comprise threads, apertures to receive one or more fasteners, or a geometrical interface configured couple drain bowl strainer 200 to inlet conduit 106. In various embodiments, and with specific reference to FIG. 1, inlet conduit 106 may comprise one or more protrusions 128 and one or more recesses 130. Protrusions 128 of inlet conduit 106 may be configured to align with recesses 204 on drain bowl strainer 200 and recesses 130 of inlet conduit 106 may be configured to align with protrusions 202 on drain bowl strainer 200. In such a way, drain bowl strainer 200 may be easily coupled to and/or removed from sump drain frame 100 by placing drain bowl strainer 200 in inlet conduit 106 and may be restrained from rotating about the Y-axis relative to sump drain frame 100.

In various embodiments, an inlet conduit may be directly coupled to the outlet conduit. In such cases, a transitional surface may be disposed between the inlet conduit and the outlet conduit, and/or between a ramp or first land and the inlet conduit. The transitional surface may be configured to converge a flow of drainage water. Such a transitional surface may be referred to as a drain bowl.

In various embodiments, the drain inlet (e.g., comprising inlet conduit 106 and/or drain bowl 104) may be coupled to first land 108. Drain bowl 104 may be coupled to first land 108 by inlet conduit 106 coupled to and spanning between drain bowl 104 and first land 108. In various embodiments, drain bowl 104 may be adjacent to and connected to first land 108. First land 108 may be an annulus extending around (e.g., circumferentially around) the drain inlet, and may be configured to deliver drainage water thereto (e.g., to inlet conduit 106 and/or drain bowl 104), and/or to outlet pipe 102. For example, in various embodiments, an upper surface 132 of first land 108 may be flush with an inlet surface 206 of drain bowl strainer 200 such that water may flow from first land 108 to inlet conduit 106 without having to first travel up a gradient. As a result, standing water is unlikely to form on first land 108. In various embodiments, with reference to FIGS. 7A and 7B, a drain bowl strainer 750 may be disposed on and/or coupled to a first land (e.g., first land 708) of a sump drain frame (e.g., sump drain frame 700A).

In various embodiments, first land 108 may comprise a width, W1, of between approximately 0 inches (0 cm) and 4 inches (10.16 cm), between approximately 1 inch (2.54 cm) and 3 inches (7.62 cm), or approximately 2 inches (5.08 cm). First land 108 may comprise a lower surface 136 configured to be placed on top of and couple to a deck 210. In various embodiments, deck 210 may comprise any suitable material, for example, a wood (e.g., plywood), polymer, ceramic, metal, or composite material. Deck 210 may comprise a height, H1, between approximately 0 inches (0 cm) to 8 inches (20.32 cm), between approximately 2 inches (5.08 cm) and 6 inches (15.24 cm), or approximately 4 inches (10.16 cm), in various embodiments.

In various embodiments, first land 108 may be adjacent to and connected to ramp 110. In various embodiments, ramp 110 may be coupled to the drain inlet (e.g., inlet conduit 106 and/or drain bowl 104) by first land 108 coupled to and spanning therebetween. That is, first land 108 may be connected to and/or span between drain bowl 104 and/or inlet conduit 106 and ramp 110. In various embodiments, ramp 110 may be coupled directly to the drain inlet (e.g., inlet conduit 106 and/or drain bowl 104). Ramp 110 may be configured to be at least partially positioned on a top surface of the deck 210 (in the Y-direction) and contain a sump insulation underneath ramp 110 and above deck 210. Ramp 110 may comprise any suitable shape, such as semi-spherical (e.g., a bowl shape), frusto-conical, frusto-pyramidal, or the like. The ramp may be configured to converge drain water into or onto first land 108, the drain inlet (e.g., inlet conduit 106 and/or drain bowl 104), and/or outlet conduit 102. In various embodiments, ramp 110 may span between a ramp upper point and a lower point, wherein the ramp upper point may be higher (in the Y-direction) than the ramp lower point. The ramp lower point may be coupled to a first land, a drain inlet (e.g., an inlet conduit and/or a drain bowl), and/or an outlet conduit. In various embodiments, a ramp may comprise a protrusion extending outward from the ramp. Such a protrusion may extend for any suitable length around the sump drain frame about the drain inlet. For example, a protrusion may comprise a step or flat surface upon which another component of the sump drain system couples, such as a drain bowl strainer.

In various embodiments, ramp 110 may comprise one or more sections 138 comprising incline planes such that drainage water may flow from a roof surface to the drain inlet and onward to drain pipe 122. In various embodiments, sections 138 may extend 360° around first land 108. In various embodiments, ramp 110 may comprise four sections 138, each forming one fourth of the entire ramp 110; however, ramp 110 is not limited in this regard. Ramp 110 may comprise two, three, five, six, or any other suitable number of sections 138.

In various embodiments, each section 138 of ramp 110 may comprise a width, W2, and a height, H2. In various embodiments, width W2 may be between approximately 8 inches (20.32 cm) and 16 inches (40.64 cm), be between approximately 10 inches (25.40 cm) and 14 inches (35.56 cm), or approximately 12 inches (30.48 cm). Height H2 may be between approximately 0 inches (0 cm) and 8 inches (20.32), between approximately 2 inches (5.08 cm) and 6 inches (15.24 cm), or approximately 4 inches (10.16 cm) in various embodiments. However, each section 138 of ramp 110 is not limited in this regard and may comprise any suitable width and height. Further, while illustrated with each section 138 comprising the same width and height, sections 138 of ramp 110 are not limited in this regard and may comprise varying dimensions.

In various embodiments, with reference to FIGS. 7A-7B and 8A-8B, a sump drain frame may comprise sump channels in the ramp portion of the sump frame. For example, sump drain frames 700A and 800 may comprise sump channels 703 within ramps 710 and 810, respectively. The sump channels may be channels recessed into the ramp of the sump drain frame. On the underside of a sump drain frame comprising sump channels, there may be protrusions reflecting the recesses of the sump channels. Sump channels may be disposed in any suitable location(s) in the ramp of a sump drain frame. For example, sump channels may be disposed between ramp sections of a sump drain ramp, such as sump channels 703 being disposed between ramp sections 738 of sump drain frames 700A and 800. During manufacturing of a sump drain frame (e.g., injection molding and/or vacuum forming process), webbing may create wrinkles in various components of the sump drain frame, such as in the ramp. Such wrinkles may be utilized and formed to create the sump channels. The sump channels may span any suitable length along the ramp of a sump drain frame. For example, the sump channels may span from a point on the ramp (e.g., from a top of the ramp) to the inlet conduit, drain bowl, and/or outlet conduit, such that at least one sump channel is in fluid communication with the inlet conduit, drain bowl, and/or outlet conduit. Accordingly, sump channels may be configured to further direct water toward the inlet conduit 706 (similar to inlet conduit 106 discussed herein), drain bowl 704 (similar to drain bowl 104 discussed herein), and/or outlet conduit 702 (similar to outlet conduit 102 discussed herein) of sump drain frames 700A and/or 800. Sump channels may also provide greater structural strength of the ramp and sump drain frame.

In various embodiments, ramp 110 may be adjacent to and connected to second land 112. Ramp 110 may be connected and/or span between the drain inlet and/or first land 108 and second land 112. Second land 112 may comprise a substantially flat surface surrounding each side of ramp 110 (wherein "substantially" means within 10% of flat). Second land 112 may be configured to receive a roof membrane 212 which may be coupled to second land 112. For example, roof membrane 212 may be positioned on an upper surface 140 of second land 112 and thermally coupled to, chemically coupled to, coupled by way of adhesive, cured to, welded to or otherwise coupled to upper surface 140 of second land 112. In various embodiments, second land 112 may comprise a width, W3, between approximately 0 inches (0 cm) and 8 inches (20.32 cm), between approximately 2 inches (5.08 cm) and 6 inches (15.24 cm), or approximately 4 inches (10.16 cm). However, second land 112 is not limited in this regard and may comprise any suitable length.

In various embodiments, second land 112 may be adjacent to and connected to insulation receiving surface 114. In various embodiments, ramp 110 may be coupled to insulation receiving surface 114 by second land 112 coupled to and spanning therebetween. That is, second land 112 may be coupled to and span between ramp 110 and insulation receiving surface 114. Insulation receiving surface 114 may be substantially perpendicular to second land 112 and extend downward (in the negative Y-direction) from second land 112 (wherein "substantially" means within 10% of perpendicular). In various embodiments, insulation receiving surface 114 may be coupled directly to ramp 110, such as at an upper point of ramp 110, and extend downward therefrom. In various embodiments, insulation receiving surface 114 may comprise an outer surface 142 and an inner surface 144. Outer surface 142 may be adjacent to and abut roof insulation 216. Outer surface 142 may be configured to couple to an insulation retention clip 214. In various embodiments, roof insulation 216 may comprise a polyisocyanurate material, expanded polystyrene materials, extruded polystyrene material, or a lightweight insulating concrete material. In various embodiments, with additional reference to FIG. 7A, an insulation receiving surface (e.g., insulation receiving surface 714) may comprise ribs 715. Ribs may be recessed or protruding from insulating receiving surface 714. Ribs 715 may be configured to strengthen the insulation receiving surface and/or the sump drain frame.

Together, inner surface 144 of second land 112, ramp 110, insulation receiving surface 114, and/or deck 210 may be configured to contain or at least partially enclose sump insulation 146, which may be a polyisocyanurate material, expanded polystyrene material, extruded polystyrene material, pourable or sprayable polyurethane material, or mineral wool material in various embodiments. Specifically, after sump drain frame 100 is formed, sump insulation 146 may be sprayed or otherwise coupled to an underside of ramp 110 and second land 112 such that sump drain frame 100 may be installed in sump drain system 1000 already containing sump insulation 146 coupled to sump drain frame 100. In various embodiments, the portion of sump drain frame 100 configured to receive the sump insulation may be covered and/or enclosed by a cover 790 coupled to a lower surface of sump drain frame 100. The cover may span along any suitable area on the lower surface of the sump drain frame, such as across the entire sump drain frame lower surface, or just over the portion of the sump drain frame configured to receive the sump insulation. Such a cover may comprise any suitable material, such as a polymeric material, glass-reinforced recycled paper, fiberglass mat, and/or the like. The cover may function to provide better coupling between the sump drain frame and the roof deck (providing more surface area for adhesion and/or other coupling between the two), and/or may provide protection to the sump insulation within the sump drain frame. In various embodiments, insulation receiving surface 114 may comprise a height approximately equal to a height of roof insulation 216 and/or ramp 110. As such, in various embodiments, a height of insulation receiving surface 114 may be between approximately 0 inches (0 cm) and 8 inches (20.32), between approximately 2 inches (5.08 cm) and 6 inches (15.24 cm), or approximately 4 inches (10.16 cm).

In various embodiments, insulation receiving surface 114 may comprise one or more apertures 148 configured to receive one or more fasteners 218. Insulation retention clip 214 may comprise one or more apertures 220 configured to mate with the one or more apertures 148 in insulation receiving surface 114 and receive one or more fasteners 218. In such a way, insulation retention clip 214 may be coupled to outer surface 142 of insulation receiving surface 114 and be configured such that a lower surface of insulation retention clip 214 abuts an upper surface of roof insulation 216. As such, roof insulation 216 may be securely positioned proximate to outer surface 142 of insulation receiving surface 114. An upper surface of insulation retention clip 214 may be flush with upper surface 140 of second land 112 such that roof membrane 212 may be positioned flatly across the upper surface of insulation retention clip 214 and upper surface 140 of second land 112. In various embodiments, insulation retention clip 214 may comprise a width, W4 and a height, H3. In various embodiments, width W4 and/or height H3 may be between approximately 0 inches (0 cm) and 4 inches (10.16 cm), between approximately 1 inch (2.54 cm) and 3 inches (7.62 cm), or approximately 2 inches (5.08 cm).

A sump drain frame or system may comprise an attachment portion by which the sump drain frame or system couples to a roof deck and/or roof insulation. In various embodiments, the attachment portion may comprise an attachment flange (e.g., attachment flange 116. In such embodiments, insulation receiving surface 114 may be adjacent to and connected to attachment flange 116, in accordance with various embodiments. In various embodiments, an attachment flange may be coupled to the ramp and/or second land. For example, an attachment flange may be coupled to the ramp and/or second land by the insulation receiving surface being coupled to and spanning between. An attachment flange may extend outward or inward from insulating receiving surface 114. Attachment flange 116 may comprise one or more apertures 150 configured to receive one or more fasteners 218 and couple sump drain frame 100 to deck 210. However, attachment flange 216 is not limited in this regard and may be coupled to deck 210 by way of adhesive or using any other suitable technique. Attachment flange 116 may comprise an upper surface 152 and lower surface 154. Upper surface 152 may be configured to abut to a lower surface of roof insulation 216, while lower surface 154 may be configured to abut deck 210.

In various embodiments, a sump drain frame may comprise an attachment portion that is comprised in a portion of the sump drain frame within the perimeter of the sump drain frame defined by the insulation receiving surface. For example, with reference to FIGS. 7A-7C, sump drain frames 700A and 700B of sump drain systems 7000A and 7000B, respectively, may comprise an attachment portion disposed within the perimeter defined by insulation receiving surface 714, e.g., in second land 712 (similar to second land 112). Attachment portion may comprise a fastener aperture 701 through which a fastener 718 (e.g., a screw, nail, anchor, and/or the like) may be disposed to couple sump drain frames 700A and 700B to insulation 232 and/or roof deck 210. A fastener aperture may be disposed in any suitable portion of a sump drain frame, such as through a second land (e.g., through second land 712, as shown in FIGS. 7A-7C), through a ramp (e.g., ramp 710), a first land (e.g., first land 708), an inlet conduit (e.g., inlet conduit 706), and/or a drain bowl 704. A fastener may be disposed through any such fastener aperture to couple the sump drain frame to the roof insulation and/or roof deck. In various embodiments, a fastener aperture may be configured such that the fastener, when installed to couple the sump roof frame to the roof deck, rests below the surface in which the fastener aperture is disposed. Accordingly, in embodiments in which a fastener aperture is disposed in second land (e.g., second land 712), roof membrane may be disposed over the fastener aperture and the fastener disposed therein. In various embodiments, a fastener may be disposed through any component of a sump drain system to couple the sump drain system to a roof deck.

In various embodiments, as another example of an attachment portion that is comprised in a portion of the sump drain frame within the perimeter of the sump drain frame defined by the insulation receiving surface, a sump drain may comprise an attachment portion comprising an attachment flange. Such an attachment flange may comprise a recessed attachment flange. For example, with reference to FIGS. 8A-8B, sump drain frame 800 of sump drain system 8000 may comprise an attachment portion comprising recessed attachment flanges 816. Recessed attachment flanges 816 may be disposed within the perimeter defined by insulation receiving surface 814. Insulation receiving surface 814 may comprise recesses 815 disposed therein. Recesses in the insulation receiving surface may span inwardly (i.e., toward the drain inlet) from the insulation receiving surface for any suitable distance. Recesses in the insulation receiving surface may span in the Y-direction for any suitable distance, including spanning through the surface coupled to the insulation receiving surface and/or above the recess (e.g., the ramp and/or the second land). Recesses 815 may comprise a respective recessed attachment flange 816 disposed therein. For example, a recessed attachment flange 816 may be the lower boundary of a recess 815. One or more recessed attachment flange 816 may comprise a fastener aperture 801 disposed therethrough, through which a fastener 818 may be disposed to couple sump drain frame 800 to insulation 232 and/or roof deck 210. A sump drain frame may comprise any suitable number of recesses in the insulation receiving surface (e.g., four recesses 815 in each side of the insulation receiving surface 814). Roof membrane (e.g., roof membrane 212) may be disposed over recesses in the insulation receiving surface.

Attachment portions of sump drain frames comprised within the perimeter defined by the insulation receiving surface of a sump drain frame may allow the sump drain frame to easily be disposed and fit within a desired shape or within desired dimensions. For example, if replacing a drain or sump system in an existing roof (i.e., retrofitting a sump drain frame or system in an existing roof), having all components of a sump drain frame within a certain dimension may facilitate easy placement of the sump drain frame within the hole in the roof insulation. Accordingly, the insulation receiving surface (e.g., insulation receiving surfaces 714 and 814) may easily be disposed to abut insulation 716, which may be preexisting in its position.

In various embodiments, sump drain frame 100 may comprise a square shape when viewed in the X-Z plane. For example, sump drain system 1000 may be sized and shaped such that sump drain frame 100 may be installed or retrofitted on existing roofing systems without the need to trim or otherwise alter other components of the roofing system for installation. For example, in various embodiments, sump drain frame 100 may comprise an overall width, OW, from an edge of second land 112 on one side of sump drain frame 100 to an edge of second land 112 on an opposite side of sump drain frame 100. In various embodiments, overall width OW may be between approximately 24 inches (60.96 cm) and 72 inches (182.88 cm), between approximately 36 inches (91.44 cm) and approximately 60 inches (152.4 cm), or approximately 48 inches (121.92 cm). As such, because roof insulation components (such as roof insulation paneling) are often manufactured such that at least one side of the insulation component measures 48 inches, sump drain frame 100 comprising an overall width OW of approximately 48 inches may fit existing roofing systems without the need for alteration of various components.

In accordance with various embodiments, sump drain frame 100 may be manufactured as a single, continuous, watertight component. Because of this, sump drain frame 100 may prevent leaks from forming along a flow path of drainage water better than existing sump drain systems comprising multiple components coupled together by compression fasteners or other components. In addition, sump drain frame 100 may be configured such that a connection point between roof membrane 212 and sump drain frame 100 is moved outward and away from drain pipe 122. As such, roof membrane 212 may be positioned outside of areas likely to accumulate large amounts of standing water (such as near an interface with drain bowl strainer 200), thereby making sump drain frame 100 and sump drain system 1000 less likely to experience leaks. Further, because sump drain frame 100 comprises a single, continuous, watertight component, sump drain frame 100 may be configured to house sump insulation 146 directly underneath ramp 110. As such, sump drain frame 100 may be easier to manufacture and install, while still complying with applicable construction codes requiring insulation proximate to the drain.

Figure 4A:
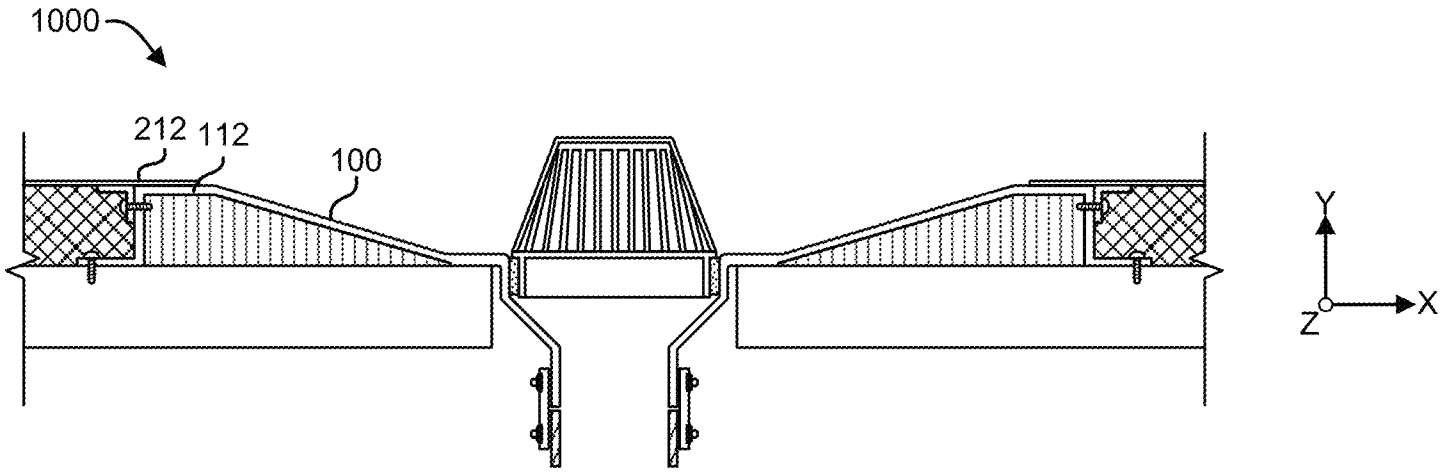
FIGS. 4A-4I illustrate various cross-sectional side views of sump drain systems, in accordance with various embodiments.

With reference now to FIGS. 4A-4H, sump drain frame 100 of sump drain system 1000 may comprise various materials having various structures. FIG. 4A illustrates a sump drain system 1000 comprising a sump drain frame 100 comprising a TPO or PVC material, in accordance with various embodiments. Roof membrane 212 may also comprise a TPO or PVC material. In various embodiments, roof membrane 212 and second land 112 of sump drain frame 100 may be thermally welded together such that a watertight seal is formed between roof membrane 212 and sump drain frame 100. However, as previously stated, roof membrane 212 may be coupled to second land 112 utilizing any suitable method.

Figure 4B:
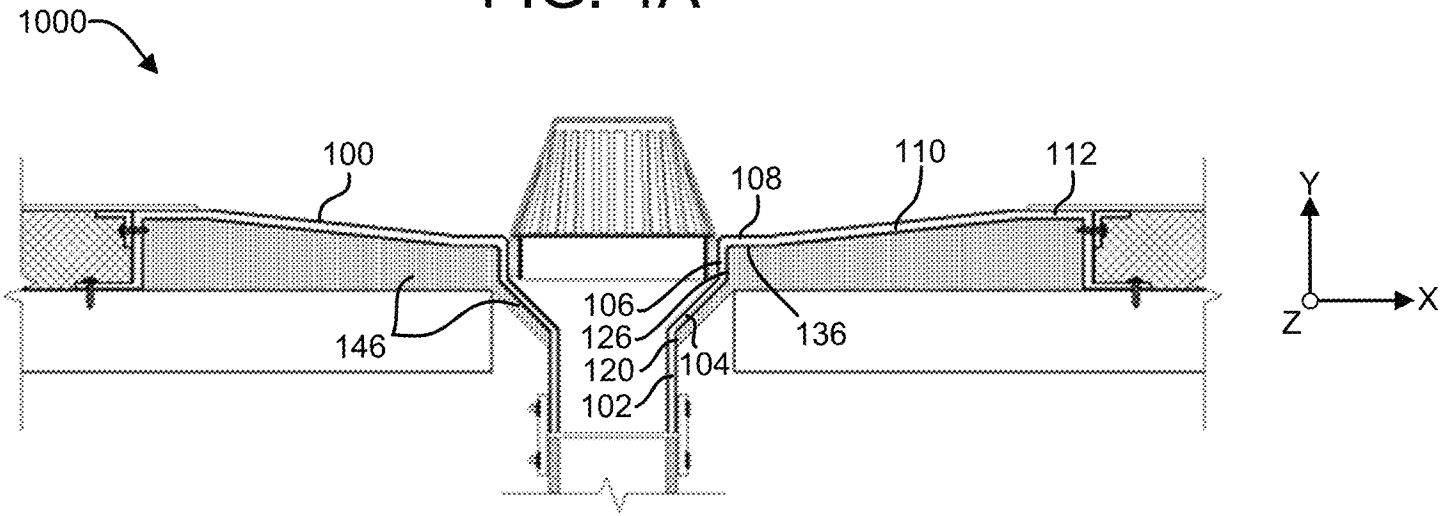

FIG. 4B illustrates another embodiment of sump drain system 1000. In some instances, due to various construction codes, it may be necessary to extend sump insulation 146 beneath other portions of sump drain frame 100. Accordingly, in various embodiments, sump drain insulation 146 may extend along a lower surface of ramp 110, lower surface 136 of first land 108, along annular outer surface 126 of inlet conduit 106, along an outer surface of drain bowl 104 and terminate at annular outer surface 120 of outlet conduit 102. As such, in various embodiments, sump drain frame 100 may incorporate sump insulation 146 along other portions of sump drain frame 100 in addition to below ramp 110 and/or second land 112.

Figure 4C:
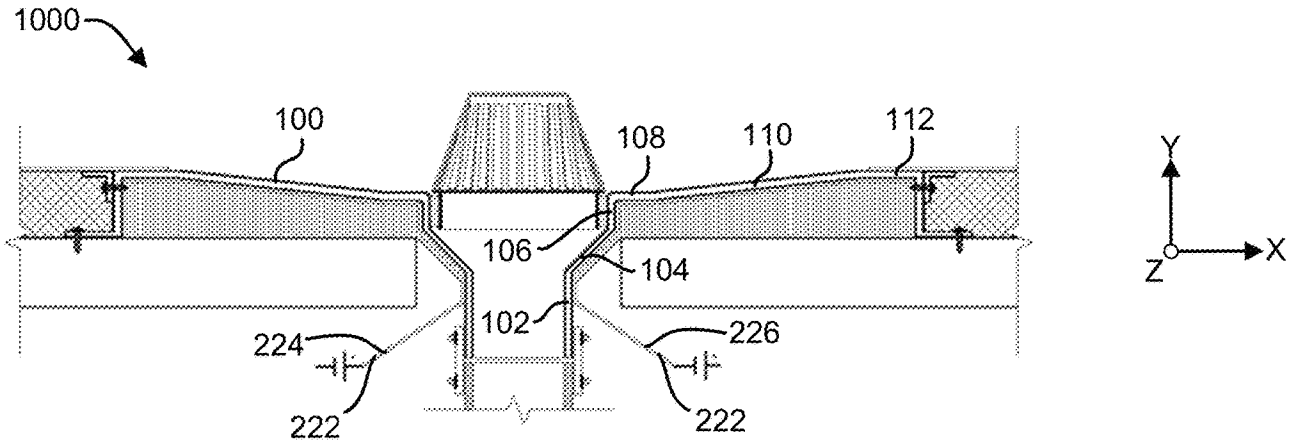

Referring now to FIG. 4C, sump drain system 1000 may comprise one or more heat traces 222, in accordance with various embodiments. Heat traces 222 may comprise a first heat trace 224 connected to one side of outlet conduit 102 and a second heat trace 226 connected to an opposite side of outlet conduit 102. First heat trace 224 and second heat trace 226 may be configured to contact outlet conduit 102, drain bowl 104, inlet conduit 106, first land 108, ramp 110, and/or second land 112 in various embodiments, however, first heat trace 224 and second heat trace 226 are not limited in this regard and may be configured to contact any number of the aforementioned components.

First heat trace 224 and second heat trace 226 may contact any of the aforementioned components at any location. For example, in various embodiments, first heat trace 224 and second heat trace 226 may be configured to wrap around annular components such as outlet conduit 102, drain bowl 104, or inlet conduit 106, or be configured to spread outward along multiple paths along a lower surface of ramp 110, for example. First heat trace 224 and second heat trace 226 may be configured to conduct an electric current and heat the various components contacted by first heat trace 224 and/or second heat trace 226. Accordingly, in various embodiments, first heat trace 224 and second heat trace 226 may be configured to heat various surfaces of sump drain frame 100 such that ice formation on these components is prevented and/or removed in freezing conditions.

Figure 4D:
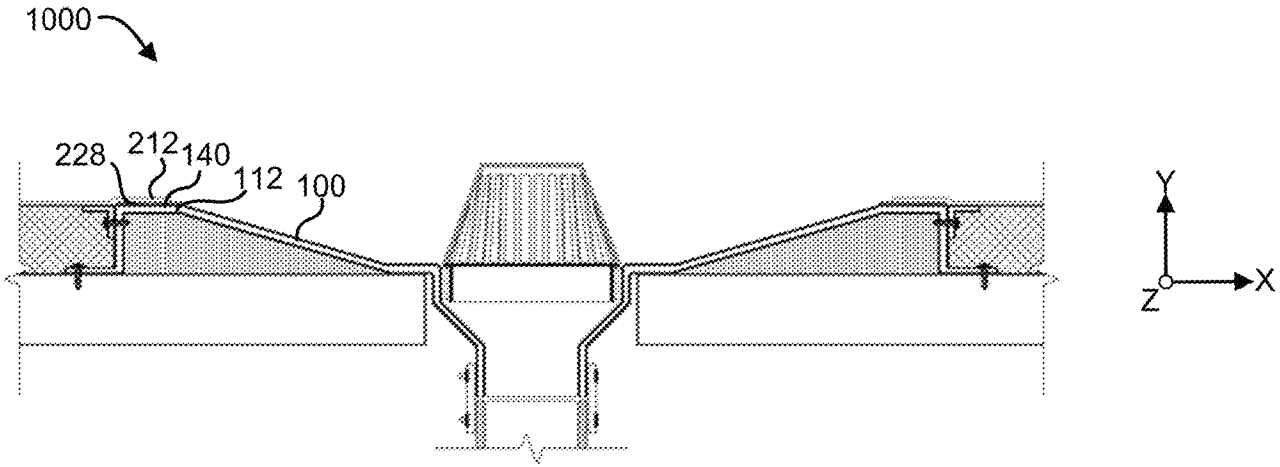

Moving on and with reference to FIG. 4D, in various embodiments, sump drain frame 100 may comprise an EPDM material. In various embodiments, the EPDM material of the sump drain frame 100 and the roof membrane 212 may be vulcanized, and may be unable to be coupled to second land 112 of sump drain frame 100 by thermal welding. As such, in various embodiments, second land 112 may be configured to receive an adhesive 228 such as a double-sided seam tape, for example. Adhesive 228 may be placed on upper surface 140 of second land 112 and be configured to receive a bottom surface of roof membrane 212. As such, roof membrane 212 be coupled to sump drain frame 100 comprising materials other than PVC or TPO utilizing various methods.

Figure 4E:
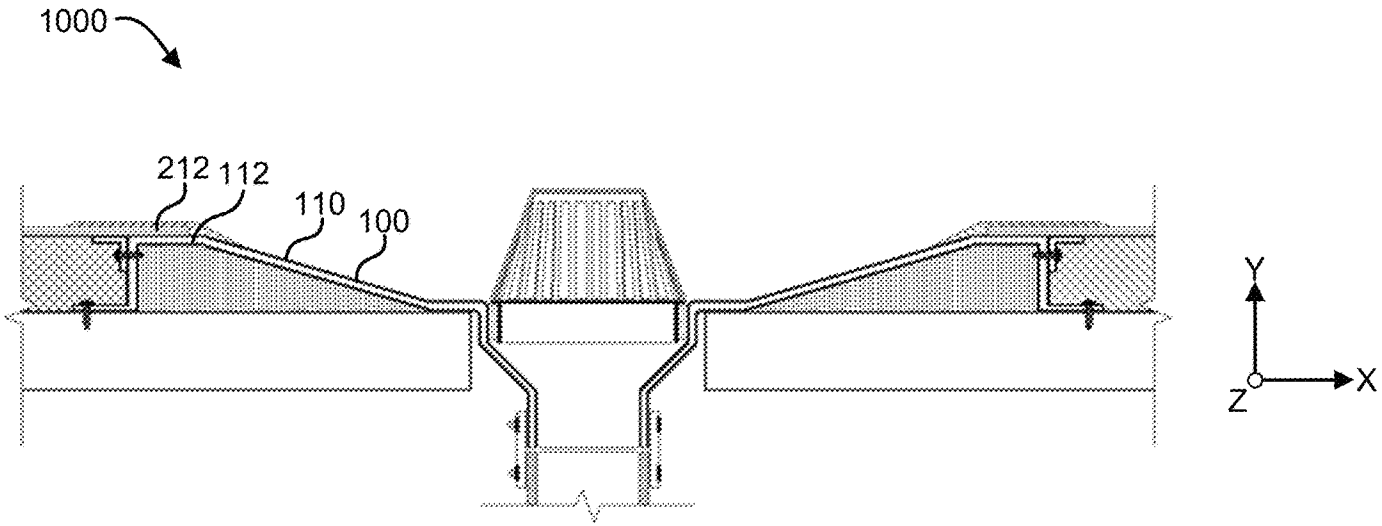

With reference to FIG. 4E, in various embodiments, an interface between a composite modified asphalt roof membrane 212 and second land 112 of sump drain frame 100 may be sealed using a polymethyl methacrylate material (or PMMA) or other suitable material. For example, roof membrane 212 may be coupled to second land 112 of sump drain frame 100 utilizing one or more of the methods previously disclosed. A PMMA material such an acrylic or an acrylic glass material may be placed over roof membrane 212, second land 112, ramp 110, and/or other portions of sump drain frame 100. PMMA may provide additional waterproofing and UV resistance such that the interface between roof membrane 212 and sump drain frame 100.

In various embodiments, it may be desirable to position sump drain frame 100 higher (in the positive Y-direction) relative to deck 210. Accordingly, in various embodiments, sump drain frame 100 may be coupled to one or more blocks 230 positioned between attachment flange 116 of sump drain frame 100 and deck 210. Each block 230 may comprise a wood material or a material similar to that of deck 210 and comprise a thickness of between approximately 0 inches (0 cm) and 4 inches (10.16 cm), between approximately 1 inch (2.54 cm) and 3 inches (7.62 cm), or approximately 2 inches (5.08 cm). As such, sump drain frame 100 may be offset a distance from deck 210 (in the positive Y-direction). In various embodiments, additional insulation in the form of board stock insulation 232 may be positioned in the gap between sump drain frame 100 and deck 210 as well as the other areas on top of deck 210. Board stock insulation 232 may at least partially extend below sump insulation 146, for example. In such a way, blocks 230 may allow for additional insulation to be utilized in conjunction with sump drain system 1000.

Figure 4F:
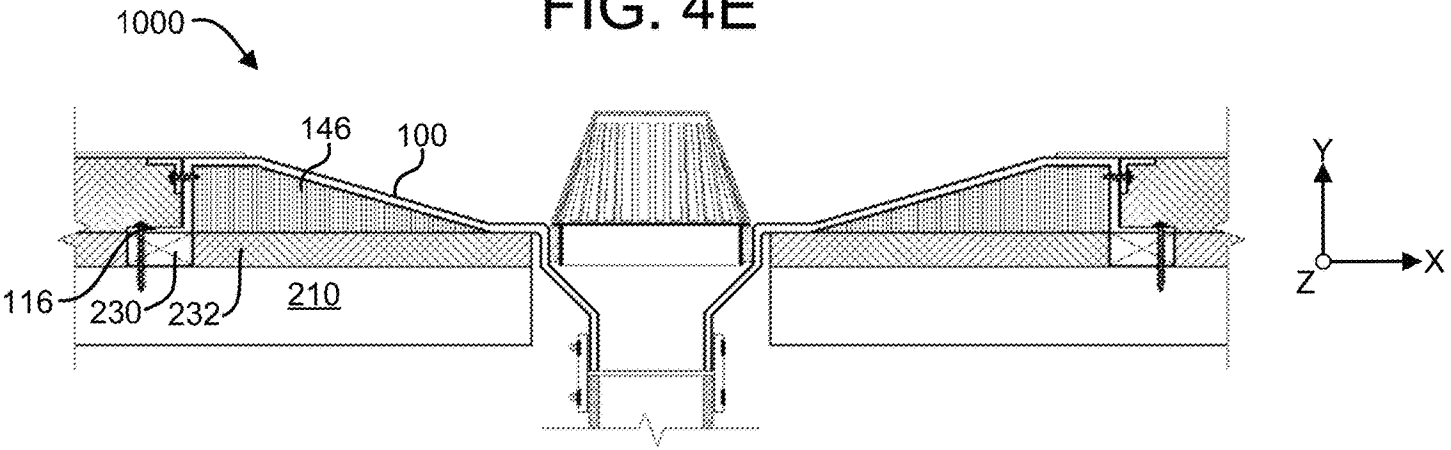
Figure 4G:
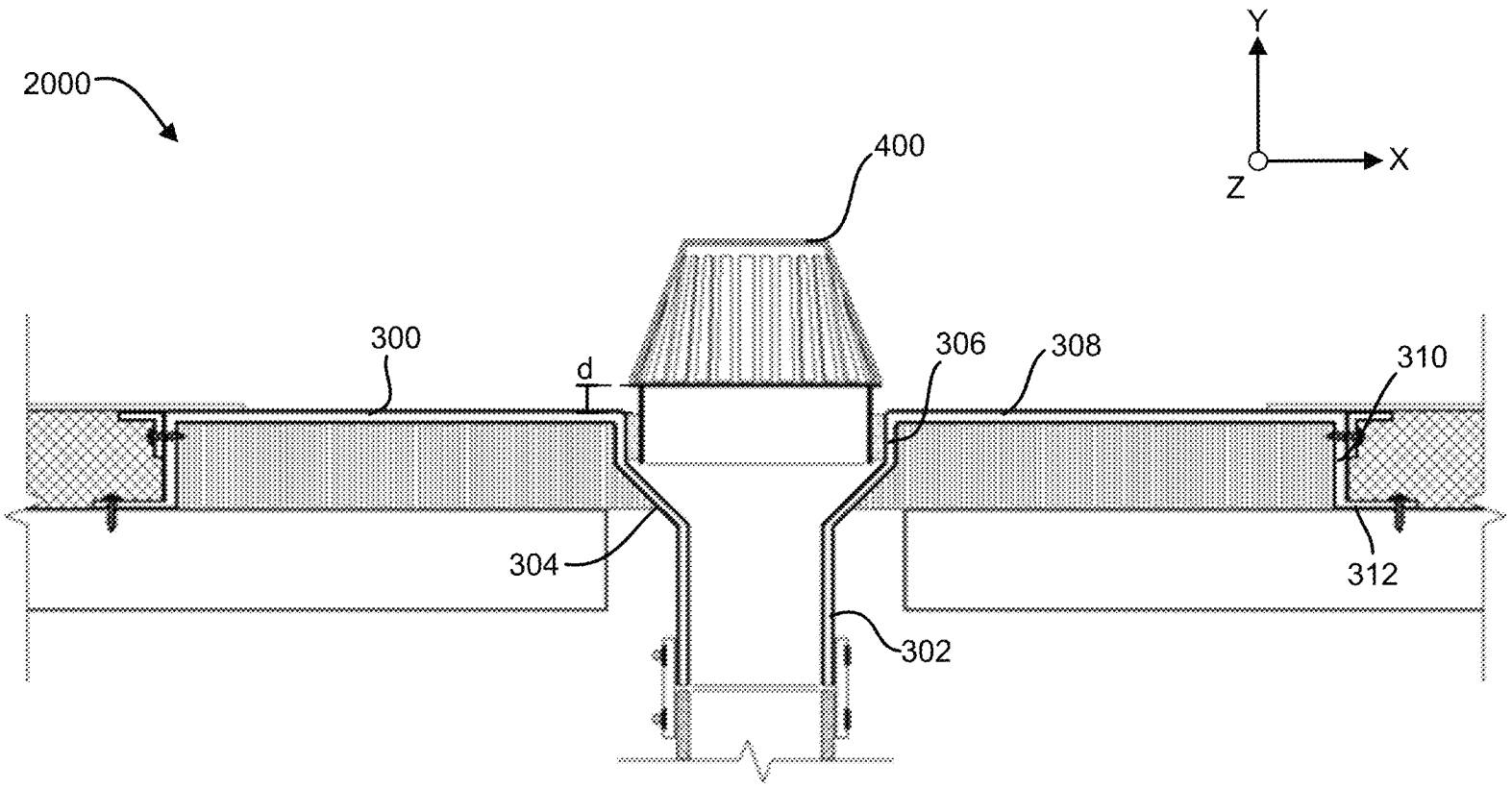
Figure 4H:
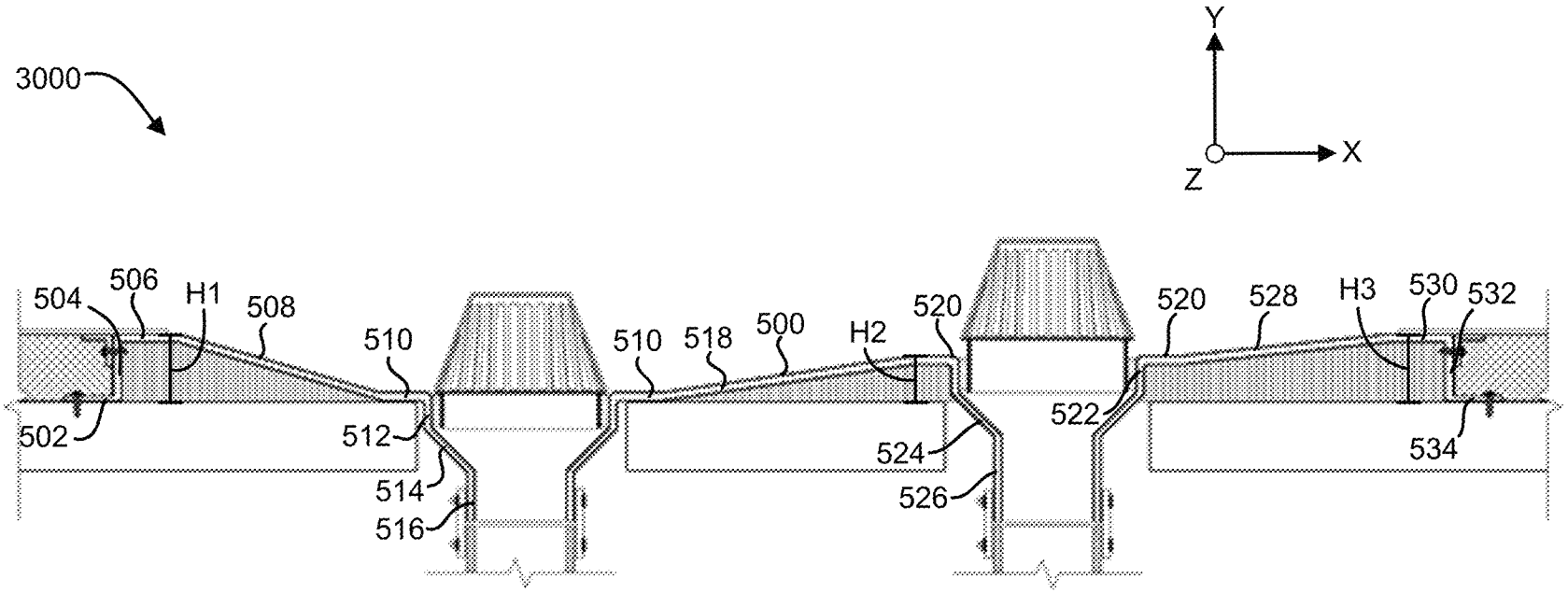
Figure 4I:
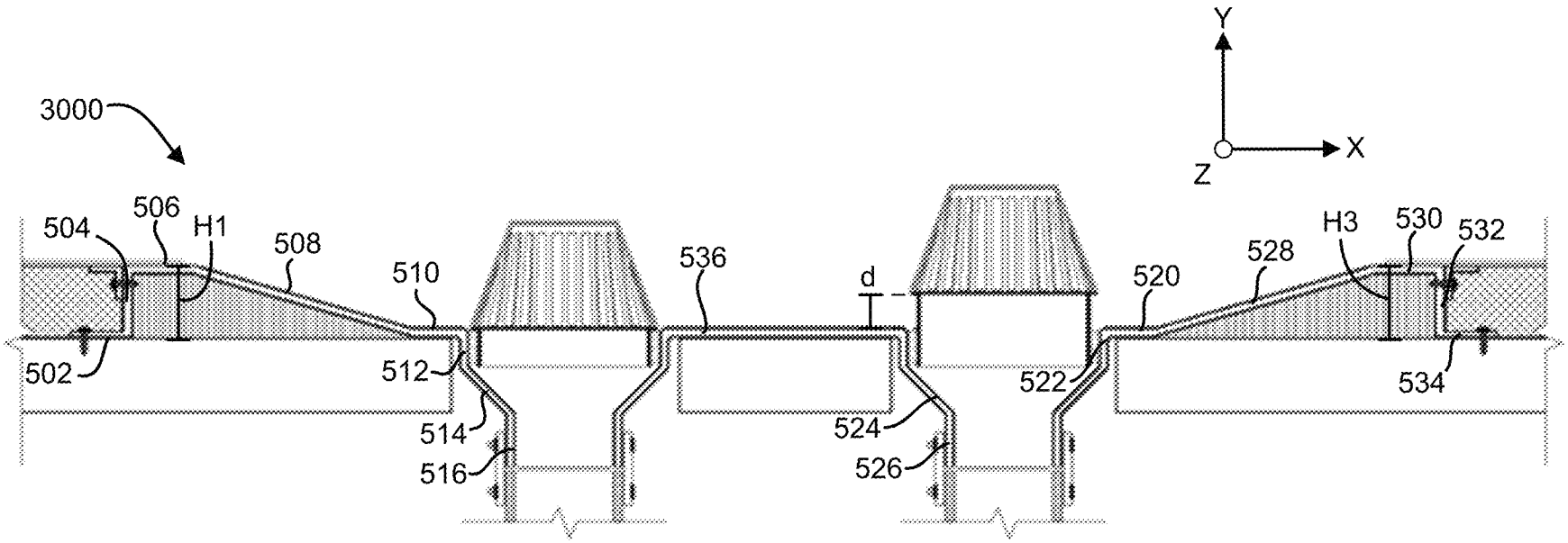

Referring now to FIG. 4G-FIG. 4I, sump drain system 1000 may be configured to couple to an overflow system 2000, in accordance with various embodiments. For example, referring to FIG. 4G, overflow system 2000 may be configured to allow drainage water to be evacuated from the roof in the event other drains, such as the sump drain, become clogged due to the presence of debris or ice. Overflow system 2000 may be configured to be installed along with the sump drain system such as at a location adjacent to the sump drain system, in accordance with various embodiments. Overflow system 2000 may comprise an overflow frame 300 substantially similar to sump drain frame 100 in various embodiments. For example, overflow frame 300 may comprise an outlet conduit 302, drain bowl 304, inlet conduit 306, insulation receiving surface 310, and attachment flange 312 similar to those described with respect to sump drain frame 100. However, in various embodiments, overflow frame 300 may comprise a land 308 comprising a substantially flat surface extending from inlet conduit 306 to insulation receiving surface 310. In such a way, land 308 of overflow frame 300 may replace first land 108, ramp 110, and second land 112 of sump drain frame 100 (with momentary reference to FIG. 2).

Overflow system 2000 may comprise a drain bowl strainer 400 similar to those described with respect to sump drain system 1000, however, drain bowl strainer 400 may be inserted into inlet conduit 306 such that a distance, d, exists between a bottom of drain bowl strainer 400 and land 308 when drain bowl strainer 400 is installed in overflow frame 300. As such, drainage water may not begin flowing into drain bowl strainer 400 until standing water reaches a predetermined elevation (greater than d) in the areas of the roof surrounding overflow system 2000. As previously stated, standing water may result in structural failure of the underlying roof system due to the weight of the standing water and overflow system 2000 may provide an additional outlet for such standing water.

Referring now specifically to FIG. 4H, a cross-sectional view of a dual emergency sump drain system 3000 is illustrated, in accordance with various embodiments. Dual emergency sump drain system 3000 may comprise a frame 500 comprising a sump drain frame, similar to sump drain frame 100 described with reference to FIG. 1-FIG. 3, coupled to an overflow frame. Sump drain frame and overflow frame may be formed together as a single, continuous component to form frame 500 utilizing any of the suitable manufacturing techniques previously mentioned, however, are not limited in this regard and may comprise separate components coupled together after each component is manufactured.

Moving from left to right, frame 500 may comprise a first attachment flange 502 connected to a first insulation receiving surface 504. First insulation receiving surface 504 may be connected to a first land 506 which be connected to a first ramp 508. First ramp 508 may comprise a decline plane extending downward (in the negative Y-direction) and connecting to a second land 510. Second land 510 may be connected to a sump inlet conduit 512 which may connect to a sump drain bowl 514 connected to sump outlet conduit 516. In various embodiments, second land 510 may also be connected to a second ramp 518 which may comprise an incline plane extending upward (in the positive Y-direction).

In various embodiments, second ramp 518 may connect to a third land 520. Third land 520 may be connected to an overflow inlet conduit 522, which may connect to an overflow drain bowl 524. Overflow drain bowl 524 may connect to an overflow outlet conduit 526. In various embodiments, third land 520 may also be connected to a third ramp 528. Third ramp 528 may comprise an incline plane extending upward (in the positive Y-direction) from third land 520 to a fourth land 530. Fourth land 530 may be connected to a second insulation receiving surface 532 which may connect to a second retention flange 534.

In various embodiments, first ramp 508 may comprise a first height, H1, second ramp 518 may comprise a second height, H2, and third ramp 528 may comprise a third height, H3. In various embodiments, first height H1 may be approximately equal to third height H3. First height H1 and third height H3 may each be greater than second height H2 in various embodiments. As such, drainage water may be configured to flow down first ramp 508 and/or third ramp 528 toward sump inlet conduit 512. In the event sump inlet conduit 512, sump drain bowl 514, and/or sump outlet conduit 516 become clogged, standing water may form on second land 510, first ramp 508, and/or second ramp 518. Because a second height H2 of second ramp 518 is less than a first height of first ramp 508 and a third height of third ramp 528, drainage water may flow into overflow inlet conduit 522 before spilling out onto the remaining portions of the roof proximate to first land 506 and/or fourth land 530.

Referring now to FIG. 4I, in various embodiments, dual emergency sump drain system 3000 may comprise a flat surface 536 extending between the sump drain and the overflow drain instead of/in addition to a second ramp. For example, in various embodiments, first height H1 of first ramp 508 may be approximately equal to third height H3 of third ramp 528. Rather than comprising a second ramp comprising a second height less than H1 and/or H2, a drain bowl strainer 538 of the overflow drain may be offset a distance, d (in the positive Y-direction) from flat surface 536. In various embodiments, d may be less than H1 and/or H3.

As such, similar to the dual emergency sump drain system 3000 of FIG. 3G, drainage water may flow into the overflow drain before spilling out onto the remaining portions of the roof proximate to first land 506 and/or fourth land 530.

Figure 5A:
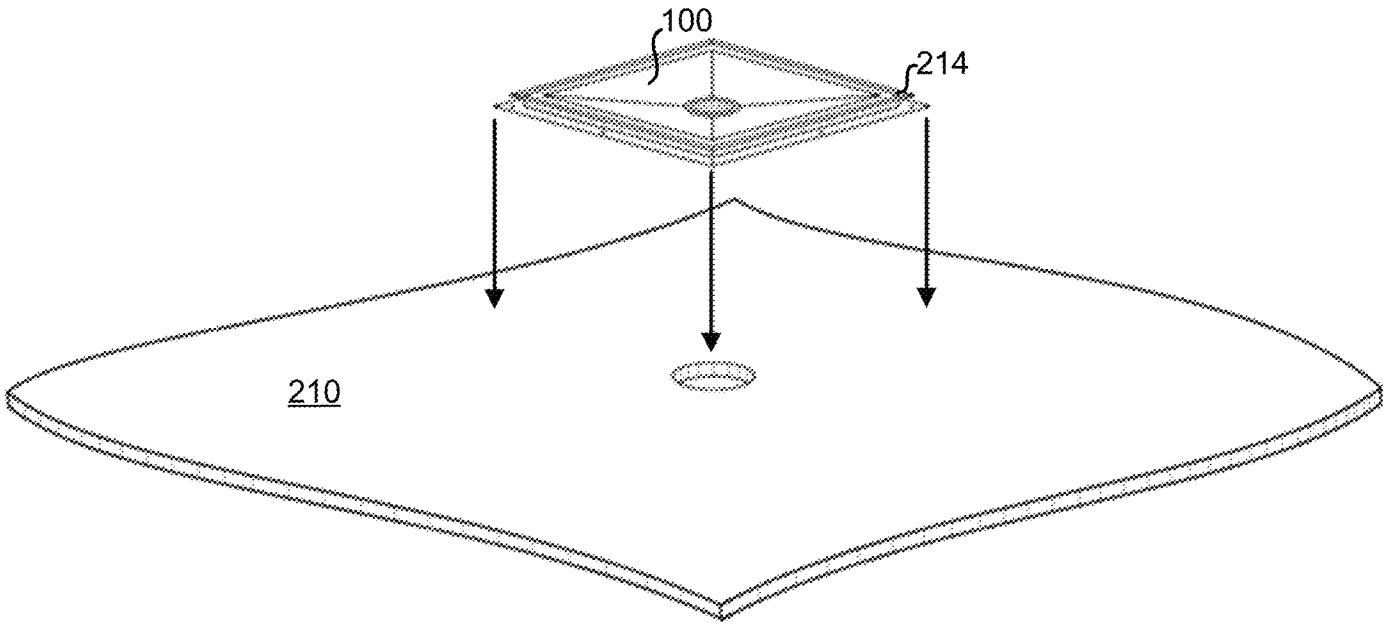
FIGS. 5A-5G illustrate perspective views of various steps of a method of constructing a sump drain system, in accordance with various embodiments.
Figure 5B:
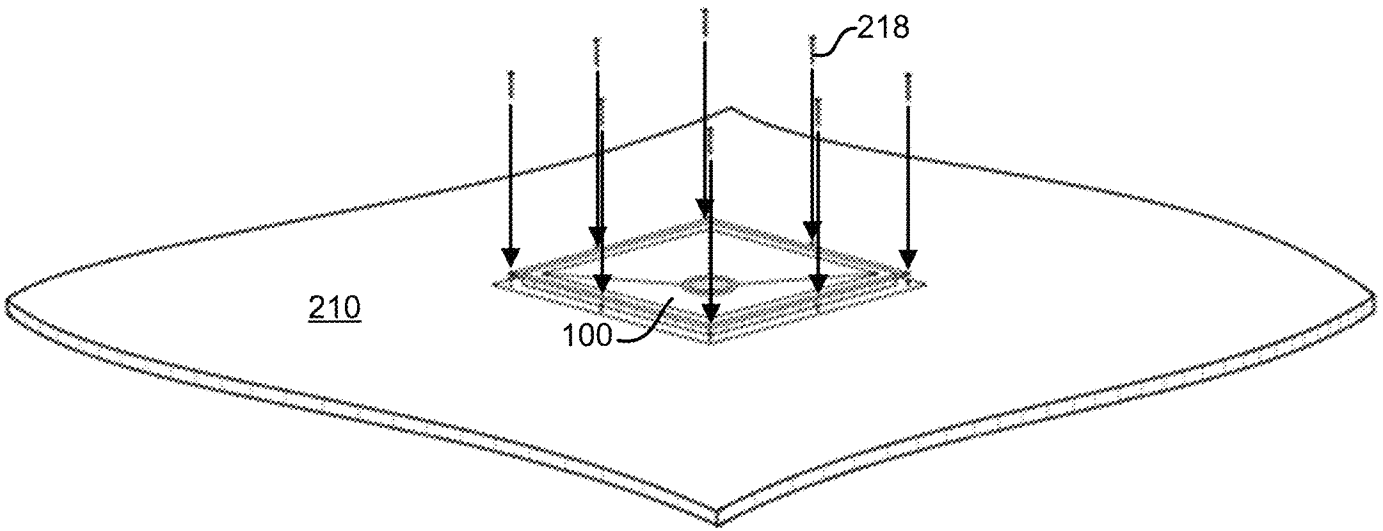
Figure 5C:
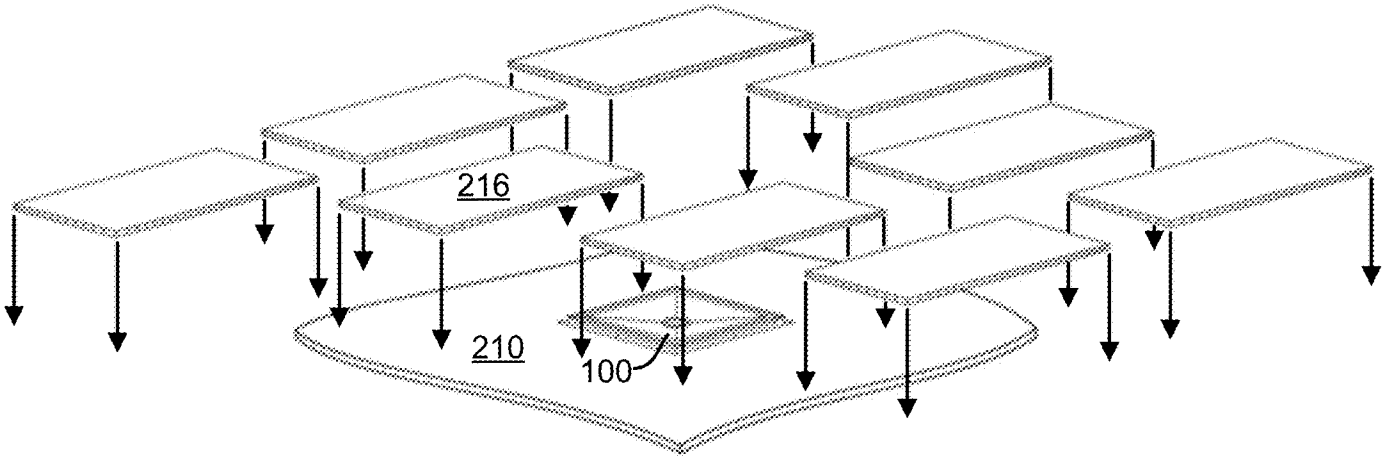
Figure 5D:
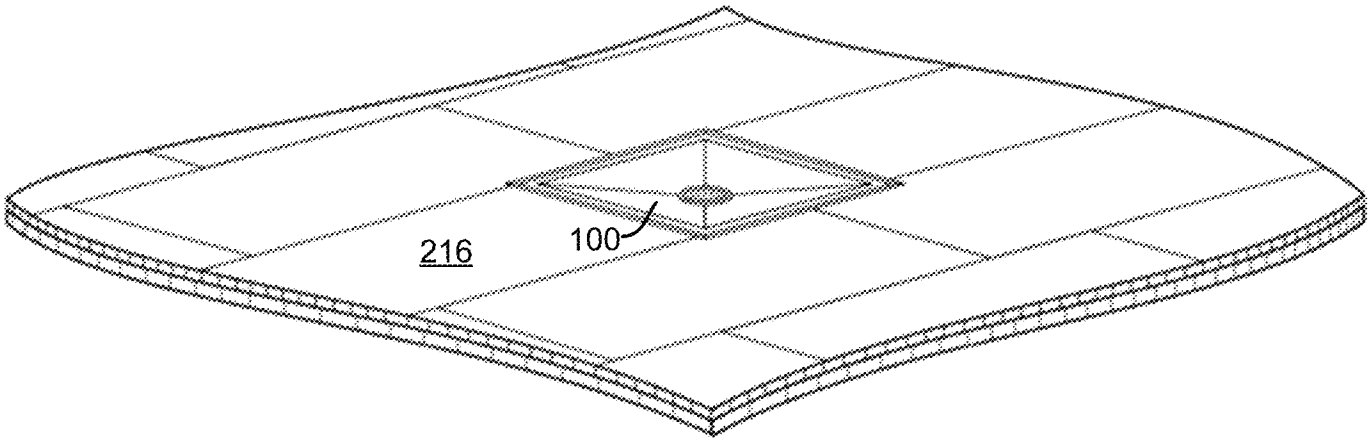
Figure 5E:
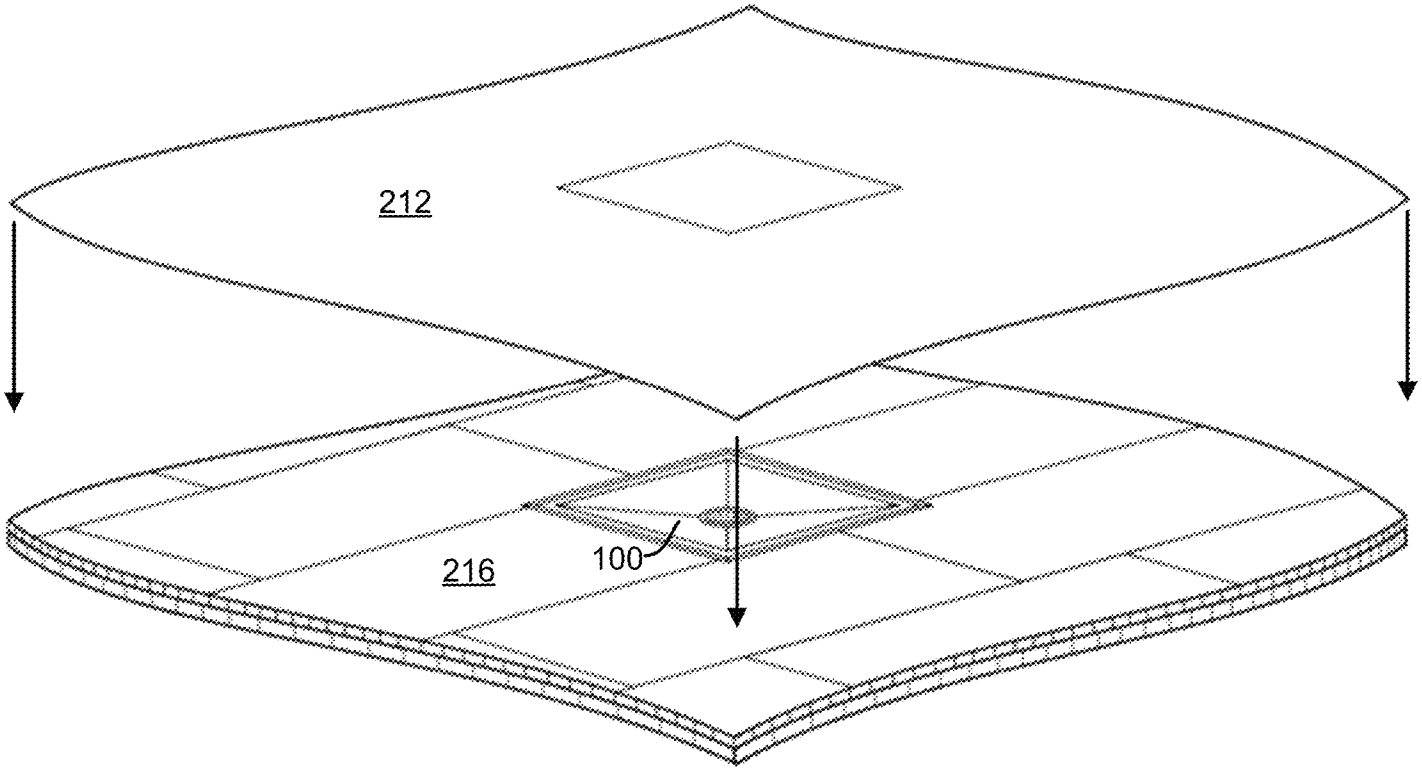
Figure 5F:
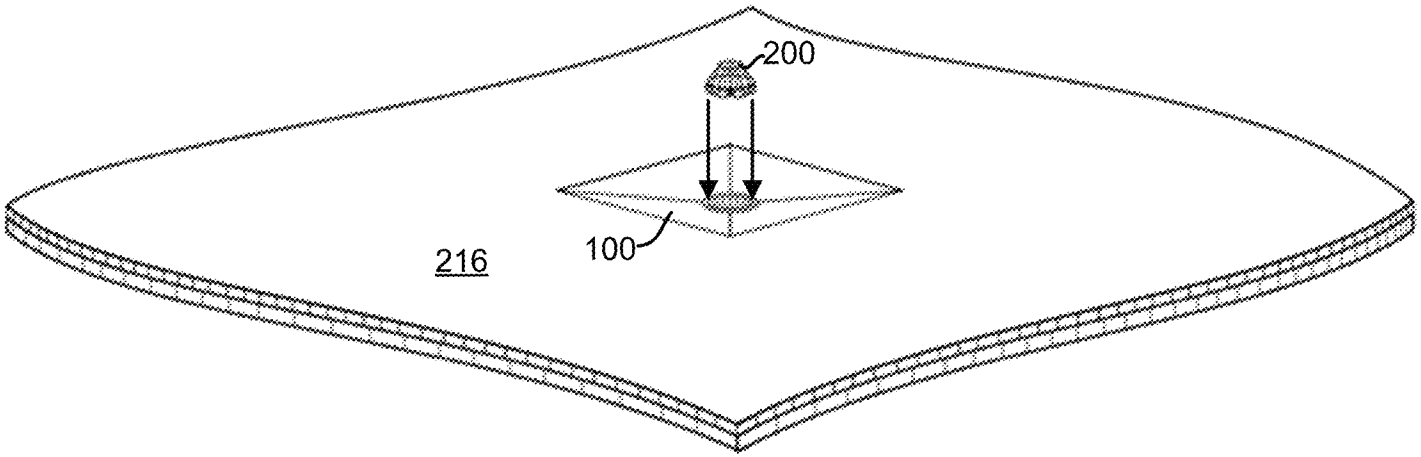
Figure 5G:
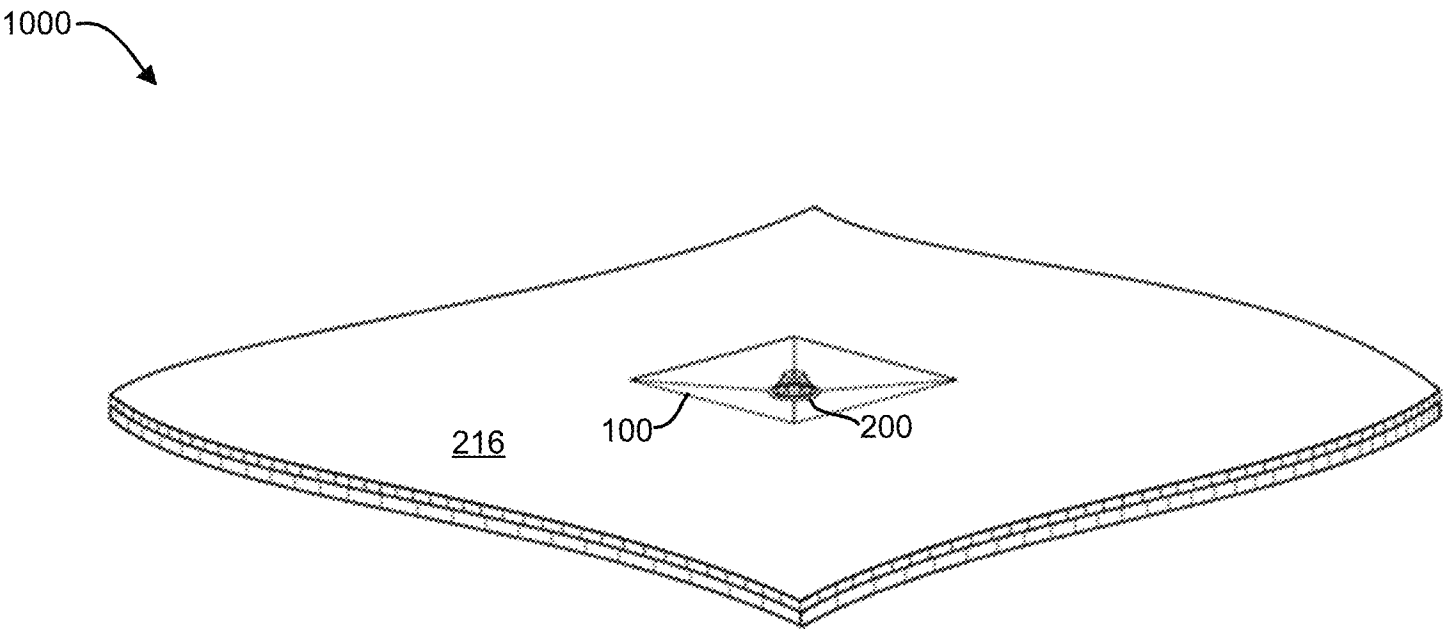

A method of constructing sump drain system 1000 is illustrated in FIGS. 5A-5G. Referring initially to FIG. 5A, deck 210 may be constructed of various materials and be configured to support other components of sump drain system 1000. A hole may be cut in deck 210 and be configured to receive an inlet conduit 106, drain bowl 104, and outlet conduit 102 of a sump drain frame 100 (FIG. 5A). Sump drain frame 100 (already comprising insulation retention clip 214) may be aligned with the hole in deck 210 and be fastened to the deck using a plurality of fasteners 218 extending through the plurality of apertures 150 in attachment flange 116 (FIG. 5B). Roof insulation 216 may be positioned around sump drain frame 100 (FIG. 5C). Roof insulation 216 may align with at least one side of sump drain frame 100 and may comprise a staggered pattern of multiple boards, in various embodiments. Roof insulation 216 may be positioned between insulation retention clip 214 and attachment flange 116 and contact insulation receiving surface 114 (FIG. 5D). Roof membrane 212 may be placed over roof insulation 216 and coupled to second land 112 (FIG. 5E). Drain bowl strainer 200 may be coupled to inlet conduit 106 of sump drain frame 100 (FIGS. 5F and 5G).

Referring now to FIGS. 6A-6E, a sump drain frame 600 may be configured such that sump drain frame 600 may be inserted into existing roofing systems, in accordance in various embodiments. Stated otherwise, existing roofing systems may be retrofitted with sump drain system 1000 or sump drain frame 600 such that the existing roofing system may exhibit the same favorable anti-leaking qualities associated with sump drain system 1000 and/or sump drain frame 600. As such, sump drain system 1000 and/or sump drain frame 100 may be included as part of a newly assembly roofing drainage system or included in older, existing roofing drainage systems.

In various embodiments, sump drain frame 600 may be substantially similar to sump drain frame 100 described with reference to FIG. 2, however, sump drain frame 600 may comprise a structure suitable for fitting within existing roofing systems. For example, in various embodiments, in contrast to drain bowl 104 and inlet conduit 106 (with momentary reference to FIG. 2), sump drain frame 600 may comprise a curved annular portion 656 and a linear annular portion 658. Curved annular portion 656 may be configured to guide water to linear annular portion 658, which may be configured to direct water to drain pipe 122.

Figure 8A:
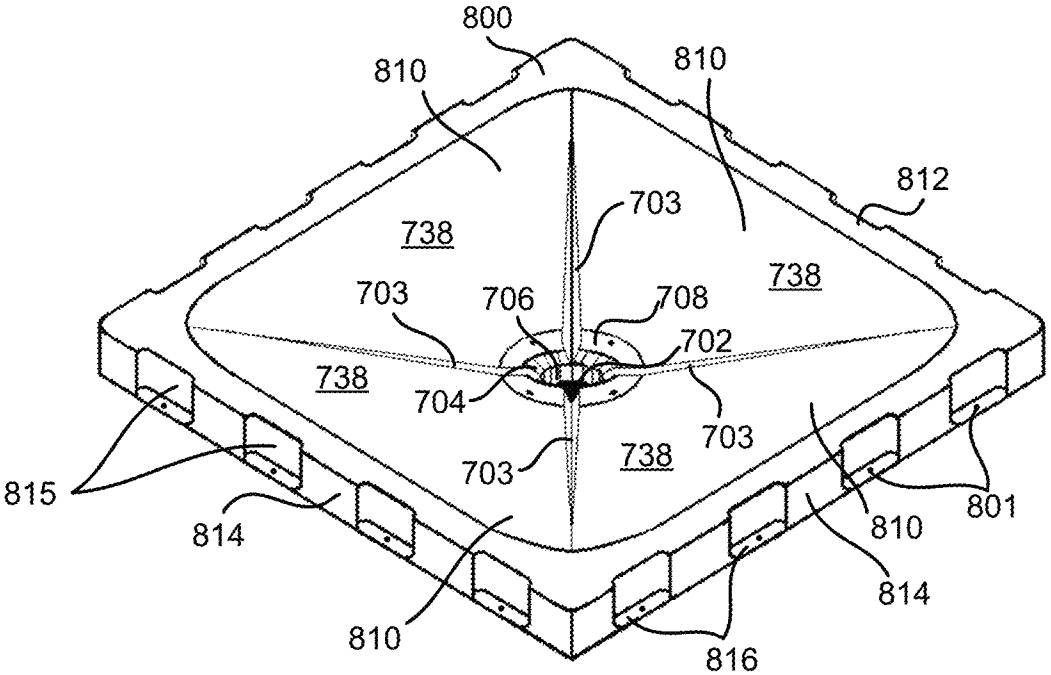
FIG. 8A illustrates a perspective view of a sump drain frame, in accordance with various embodiments.
Figure 8B:
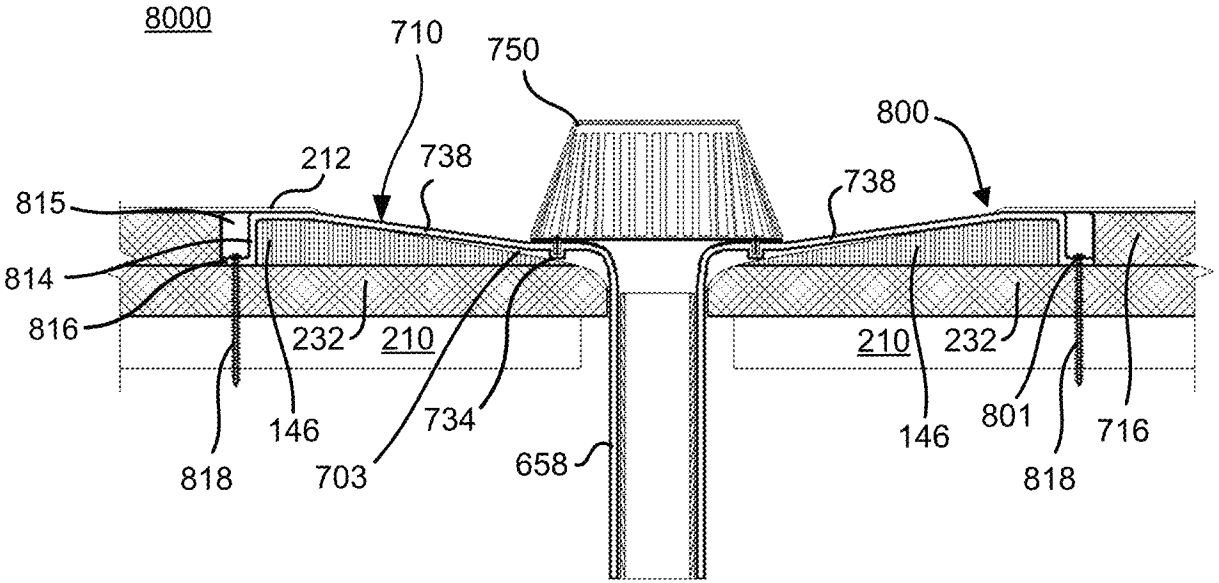
FIG. 8B illustrates a cross-sectional side view of the sump drain frame of FIG. 8A and a drain bowl strainer of a sump drain system, in accordance with various embodiments.

Sump drain system 1000 may comprise a drain bowl strainer 200 which may be similar to the drain bowl strainer described with reference to FIG. 2. However, because sump drain frame 600 may be configured to fit within existing roofing systems without the need to drastically alter the structure of the roofing system, drain bowl strainer 200 may be configured to couple directly sump drain frame (for example, a land of sump drain frame) without the need to geometrically align with the structure of sump drain frame 600. For example, in various embodiments, drain bowl strainer 200 may be coupled directly to sump drain frame 600 using one or more fasteners 234. In various embodiments, fasteners 234 may comprise any suitable structure for removably or permanently fixing drain bowl strainer 200 to sump drain frame 600, including screws, nails, bolts, brazed joints, welded joints, or any other suitable connection method. In various embodiments, fasteners 234 may be coupled to strainer 200 and disposed into recesses 734 (as depicted in FIGS. 7B and 8B) to couple strainer 200 to the sump drain frame. In various embodiments, fasteners may be coupled to the sump drain frame and disposed into the strainer to couple the strainer to the sump drain frame (e.g., as shown in FIG. 7C). The strainer may be coupled to any suitable component of a sump drain frame, such as a drain bowl, inlet conduit, first land, ramp, and/or second land.

In various embodiments, and similar to the sump drain frame described with reference to FIG. 4F, additional insulation may be required in certain roofing applications. As such, sump drain frame 600 may be coupled directly to board stock insulation 232. In various embodiments, sump drain frame 600 may be removably or permanently coupled to deck 210 by fastener 218. For example, in various embodiments, a screw, nail, bolt, or the like may be inserted through a portion of sump drain frame 600, through board stock insulation 232, and into deck 210. In various embodiments, sump drain system 1000 may include blocks (similar to blocks 230 described with reference to FIG. 4F) to assist in coupling sump drain frame 600 to deck 210, however, is not limited in this regard and may not comprise blocks in certain embodiments.

Sump drain frame 600 may further comprise a membrane terminal feature 660 extending around a perimeter of sump drain frame 600. For example, in certain applications, it may be beneficial to quickly cut away a portion of the surrounding roof membrane 212 to install sump drain frame 600. In such applications, sump drain frame 600 may be first coupled to deck 210 and later be covered with roof membrane 212. Membrane terminal feature 660 may provide a tracing path for the individual installing sump drain frame 600. For example, after covering sump drain frame with roof membrane 212, the individual may insert a knife edge or other tool to trace the profile defined by the membrane terminal feature and quickly and efficiently remove the excess portions of roof membrane 212. In various embodiments, membrane terminal feature 660 may comprise a concave or convex feature of any desired cross-sectional shape. In this regard, membrane terminal feature 660 may decrease the time and effort required to install sump drain frame 600 into existing roofing systems.

Figure 6A:
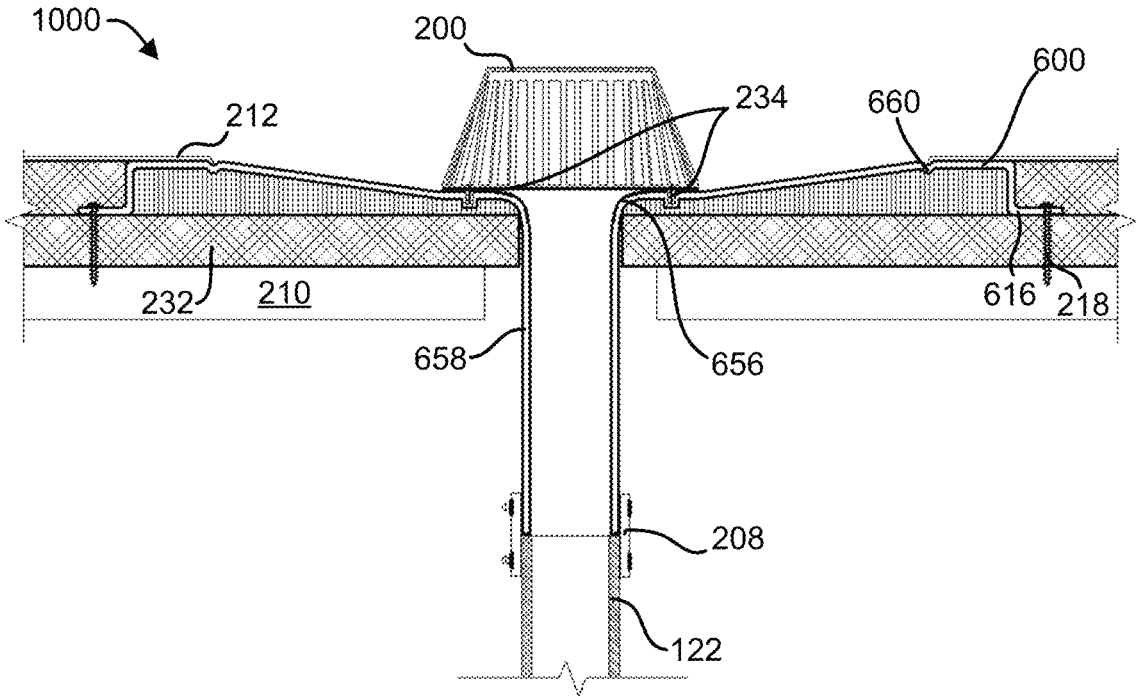
FIGS. 6A-6E illustrate various cross-sectional side views of sump drain systems configured to be retrofitted into existing roofing systems, in accordance with various embodiments.
Figure 6B:
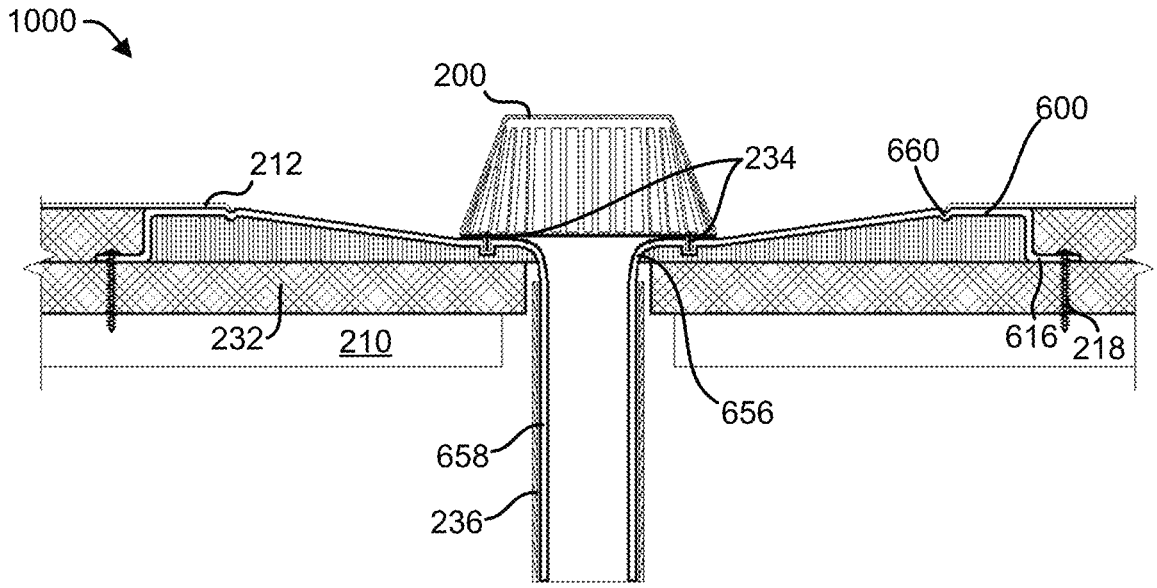
Figure 6C:
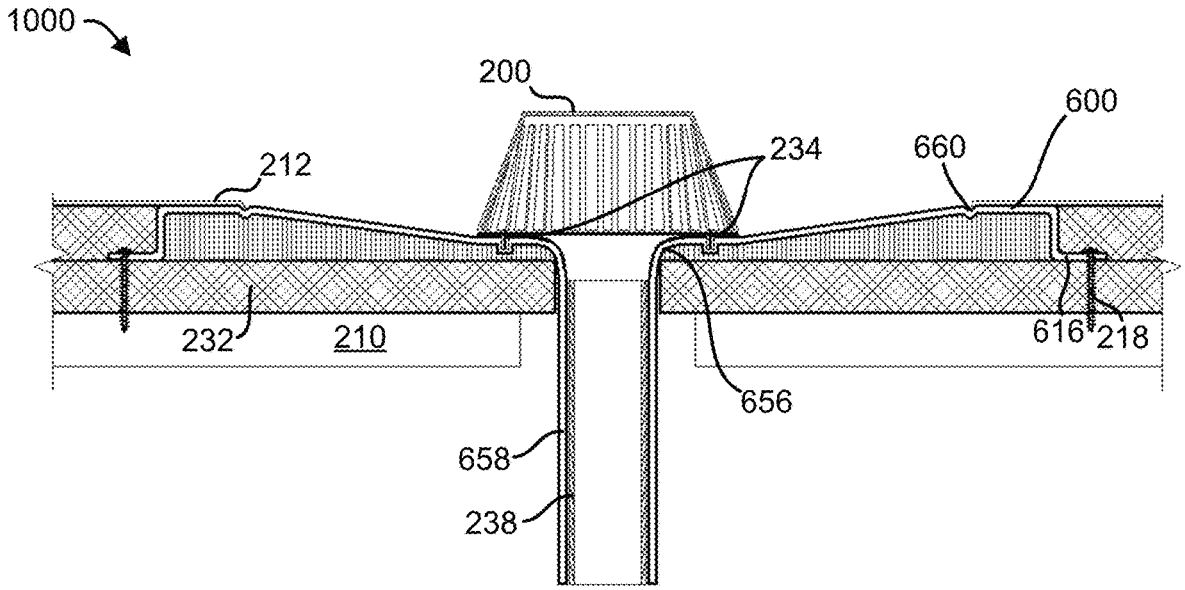

Referring now to FIG. 6B and FIG. 6C, sump drain frame 600 may further comprise a reinforcing feature configured to increase stability to linear annular portion 658. For example, in various embodiments, sump drain frame 600 may include an outer reinforcing feature 236 (FIG. 6B) and/or an inner reinforcing feature 238 (FIG. 6C). Outer reinforcing feature 236 may be coupled to an outer surface of linear annular portion 658, while inner reinforcing feature may be coupled to an inner surface of linear annular portion 658. Outer reinforcing feature and/or inner reinforcing feature may comprise any suitable material configured to increase the stability of linear annular portion, for example, a metal alloy material or polymer material.

Figure 6D:
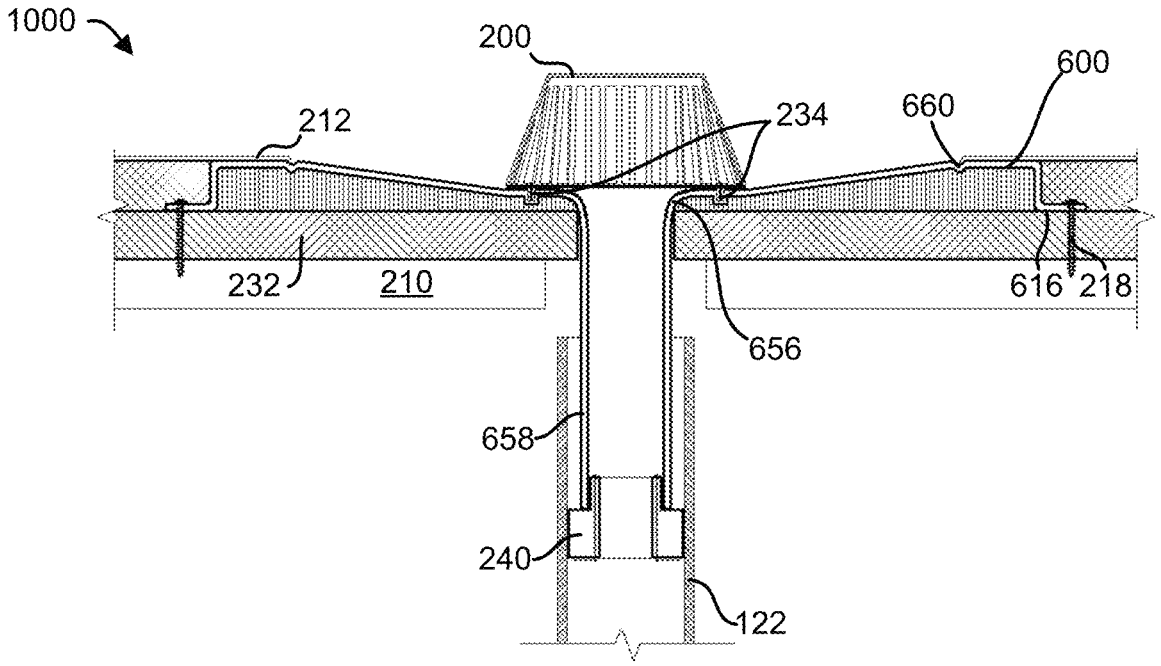
Figure 6E:
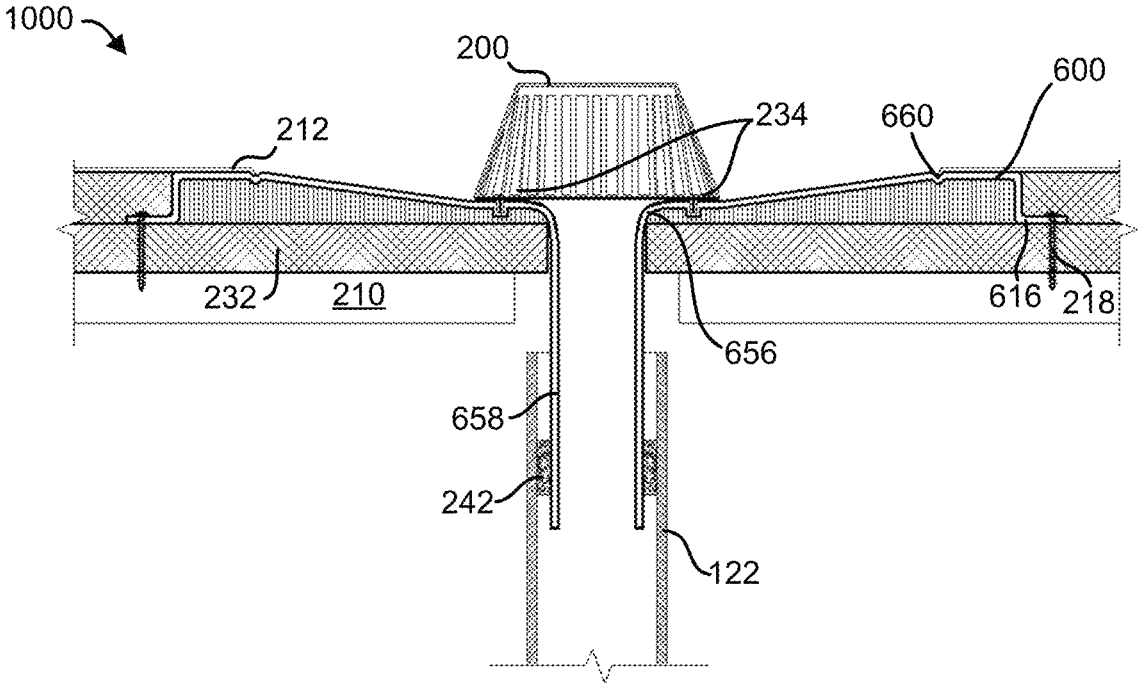

Referring now to FIG. 6D and FIG. 6E, in some instances, drain pipe 122 be comprise a diameter which does not correspond to a diameter of linear annular portion 658, thereby making a no-hub connector or other attachment option undesirable or unachievable. As such, in various embodiments, sump drain system 1000 may comprise a suitable structure or device capable of coupling linear annular portion 658 of sump drain frame 600 to drain pipe 122 despite the mismatch in diameters.

Specifically, with reference to FIG. 6D, sump drain frame 600 may be equipped with a mechanical seal 240 coupled to linear annular portion 658. Mechanical seal 240 may comprise any suitable structure configured to mate with an inner surface of linear annular portion 658 and expand to contact an inner surface of pipe drain 122. In this regard, linear annular portion 658 comprising a diameter less than pipe drain 122 may be inserted into pipe drain 122 yet still constrain movement of linear annular portion 658 and sump drain frame 600 relative to drain pipe 122. In various embodiments, mechanical seal 240 may comprise a screw element coupled to a head element, wherein the screw element may be configured to increase a diameter of the head element in response to being rotated in a first direction, while being configured to decrease a diameter of the head element in response to being rotated in a second direction opposite the first direction. This functionality may allow linear annular portion 658 to be inserted into drain pipe 122 and mechanical seal 240 may exert a radial force on the inner surface drain pipe 122, thereby constraining movement of linear annular portion 658 relative to drain pipe 122. In the event sump drain frame 600 requires removal, the screw element may be rotated in the second direction, thereby decreasing the diameter of the head element and removing the radial force on the inner surface of drain pipe 122. While discussed herein as comprising a screw element and a head element, mechanical seal 240 is not limited in this regard and may comprise of a ratcheting mechanism or a worm gear mechanism may exert a radial force on the inner surface drain pipe 122. Further, while discussed herein as exerting a radial force on an inner surface of drain pipe 122, sump drain system is not limited in this regard. For example, in various embodiments, linear annular portion 658 may comprise a diameter greater than that of drain pipe 122. In such embodiments, mechanical seal 240 may be configured to apply a radial force to an outer surface of drain pipe 122 and be equipped with a component to prevent water from leaking between linear annular portion 658 and drain pipe 122 as water exits from linear annular portion 658. Numerous embodiments are contemplated herein.

Referring now to FIG. 6E, sump drain frame 600 may be equipped with a swelling seal 242 coupled to linear annular portion 658. Swelling seal 242 may comprise any suitable material configured to mate with an inner surface of linear annular portion 658 and expand to contact an inner surface of pipe drain 122. In this regard, linear annular portion 658 comprising a diameter less than pipe drain 122 may be inserted into pipe drain 122 yet still constrain movement of linear annular portion 658 and sump drain frame 600 relative to drain pipe 122. In various embodiments, swelling seal 242 may comprise an expanding foam material, for example, a polyurethane foam, silicone seal, or a water reactive composite butyl compound enhanced with sodium bentonite clay or polymers such as sodium polycarbonate. This functionality may allow linear annular portion 658 to be inserted into drain pipe 122 and swelling seal 242 may exert a radial force on the inner surface drain pipe 122, thereby constraining movement of linear annular portion 658 relative to drain pipe 122. While discussed herein as exerting a radial force on an inner surface of drain pipe 122, sump drain system is not limited in this regard. For example, in various embodiments, linear annular portion 658 may comprise a diameter greater than that of drain pipe 122. In such embodiments, swelling seal 242 may be configured to apply a radial force to an outer surface of drain pipe 122 and be equipped with a component to prevent water from leaking between linear annular portion 658 and drain pipe 122 as water exits from linear annular portion 658. Numerous embodiments are contemplated herein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, apparatuses, and systems are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A sump drain apparatus, comprising:

a drain inlet comprising at least one of an inlet conduit and a drain bowl;

a ramp coupled to the drain inlet, wherein the ramp comprises an incline plane configured to divert drainage water toward the drain inlet; and an insulation receiving surface coupled to and extending downward from the ramp, wherein the ramp and the insulation receiving surface are configured to at least partially enclose sump insulation beneath the ramp and above a roof deck.

2. The sump drain apparatus of claim 1, further comprising sump insulation below the ramp, wherein the sump insulation is configured to be positioned above the roof deck.

3. The sump drain apparatus of claim 2, wherein the sump insulation comprises at least one of a polyisocyanurate material, a polystyrene material, a polyurethane material, or a mineral wool material.

4. The sump drain apparatus of claim 1, wherein the drain inlet, the ramp, and the insulation receiving surface comprise a single, continuous structure.

5. The sump drain apparatus of claim 1, wherein the ramp spans between a ramp lower point and a ramp upper point, wherein the ramp lower point is configured to be positioned above the roof deck.

6. The sump drain apparatus of claim 1, wherein the drain inlet is configured to be disposed within the roof deck.

7. The sump drain apparatus of claim 1, wherein the ramp is coupled to the drain inlet by a first land coupled to and spanning between the drain inlet and the ramp.

8. A sump drain apparatus, comprising:

a drain inlet comprising at least one of an inlet conduit and a drain bowl; and a ramp coupled to the drain inlet, wherein the ramp comprises an incline plane configured to divert drainage water toward the drain inlet, wherein the ramp is coupled to the drain inlet by a first land coupled to and spanning between the ramp and the drain inlet, wherein the first land comprises an upper surface and a lower surface, and wherein the lower surface is configured to rest on a roof deck.

9. The sump drain apparatus of claim 8, wherein the drain inlet, the ramp, and the first land comprise a single, continuous structure.

10. The sump drain apparatus of claim 8, further comprising sump insulation below the ramp, wherein the sump insulation is configured to be positioned above the roof deck.

11. The sump drain apparatus of claim 10, wherein the sump insulation comprises at least one of a polyisocyanurate material, a polystyrene material, a polyurethane material, or a mineral wool material.

12. The sump drain apparatus of claim 8, wherein the ramp spans between a ramp lower point and a ramp upper point, wherein the ramp lower point is configured to be positioned above the roof deck.

13. The sump drain apparatus of claim 8, wherein the drain inlet is configured to be disposed within the roof deck.

14. A sump drain apparatus, comprising:

a drain inlet comprising at least one of an inlet conduit and a drain bowl, wherein the drain inlet is configured to be disposed within a roof deck; and a ramp coupled to the drain inlet, wherein the ramp comprises an incline plane that is configured to divert drainage water toward the drain inlet, wherein at least a portion of the ramp is configured to be disposed above the roof deck.

15. The sump drain apparatus of claim 14, wherein the ramp spans between a ramp lower point and a ramp upper point, wherein the ramp lower point is configured to be positioned above the roof deck, which is a wooden roof deck.

16. The sump drain apparatus of claim 15, further comprising sump insulation below the ramp lower point.

17. The sump drain apparatus of claim 14, wherein the ramp is coupled to the drain inlet by a first land coupled to and spanning between the drain inlet and the ramp.

18. The sump drain apparatus of claim 14, further comprising sump insulation below the ramp, wherein the sump insulation is configured to be positioned above the roof deck.

19. The sump drain apparatus of claim 18, wherein the sump insulation comprises at least one of a polyisocyanurate material, a polystyrene material, a polyurethane material, or a mineral wool material.

20. The sump drain apparatus of claim 14, wherein the drain inlet and the ramp comprise a single, continuous structure.

* * * * *